US006554468B1

(12) United States Patent
Manaka et al.

(10) Patent No.: US 6,554,468 B1
(45) Date of Patent: Apr. 29, 2003

(54) MECHANICAL TIMEPIECE WITH TIMED ANNULAR BALANCE ROTATING ANGLE CONTROL MECHANISM

(75) Inventors: Saburo Manaka, Chiba (JP); Koichiro Jujo, Chiba (JP); Takeshi Tokoro, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/869,286

(22) PCT Filed: Nov. 11, 1999

(86) PCT No.: PCT/JP99/06292

§ 371 (c)(1),
(2), (4) Date: Aug. 27, 2001

(87) PCT Pub. No.: WO01/35171

PCT Pub. Date: May 17, 2001

(51) Int. Cl.[7] ..... G04B 15/00; G04B 1/10; G04B 17/00

(52) U.S. Cl. ..... 368/127; 368/140; 368/169; 368/175

(58) Field of Search ..... 368/124, 125–131, 368/140, 161–164, 203–204, 168, 169, 175

(56) References Cited

U.S. PATENT DOCUMENTS 3,698,179 A * 10/1972 Kaulins
3,714,773 A * 2/1973 Diersbock
3,792,579 A * 2/1974 Inagaki
3,921,386 A * 11/1975 Keller

* cited by examiner

*Primary Examiner*—Vit Miska
(74) *Attorney, Agent, or Firm*—Adams & Wilks

(57) ABSTRACT

A mechanical time piece has a mainspring for generating a rotational force and a front train wheel for undergoing rotation in accordance with a rotational force generated by the mainspring. An escapement and speed control apparatus controls rotation of the front train wheel and has a timed annular balance for undergoing reciprocal rotational movement, an escape wheel and pinion for undergoing rotation in accordance with rotation of the front train wheel, and a pallet fork for controlling rotation of the escape wheel and pinion in accordance with rotational movement of the timed annular balance. A switch mechanism outputs an ON signal when a rotational angle of the timed annular balance becomes equal to or larger than a predetermined threshold angle and outputs an OFF signal when the rotational angle of the timed annular balance does not exceed the threshold angle. A balance rotational angle control mechanism applies a force to the timed annular balance to restrain rotation of the timed annular balance when the switch mechanism outputs the ON signal. The balance rotational angle control mechanism has a balance magnet disposed on the timed annular balance and a plurality of coils for exerting a magnetic force to the balance magnet to thereby restrain rotation of the timed annular balance when the switch mechanism outputs the ON signal and for not exerting a magnetic force to the balance magnet when the switch mechanism outputs the OFF signal.

24 Claims, 37 Drawing Sheets

MECHANICAL TIMEPIECE WITH TIMED ANNULAR BALANCE ROTATING ANGLE CONTROL MECHANISM

CROSS-REFERENCE TO RELATED APPLICATIONS

This application is a U.S. national state application of copending International Application Ser. No. PCT/JP99/06292, filed Nov. 11, 1999 claiming a priority date of Nov. 11, 1999, and published in a non-English language.

BACKGROUND OF THE INVENTION

1. Field of the Invention

The present invention relates to a mechanical time piece having a balance rotational angle control mechanism constituted to exert a force for restraining rotation of a balance with hairspring.

Particularly, the invention relates to a mechanical time piece having a balance rotational angle control mechanism including a balance magnet provided to a balance with hairspring and a coil arranged to be related to the balance magnet.

2. Background Information

According to a conventional mechanical time piece, as shown in FIG. 13 and FIG. 14, a movement (machine body) 1100 of a mechanical time piece is provided with a main plate 1102 constituting a base plate of the movement. A winding stem 1110 is rotatably integrated to a winding stem guide hole 1102*a* of the main plate 1102. A dial 1104 (shown in FIG. 14 by an imaginary line) is attached to the movement 1100.

Generally, in both sides of the main plate, a side thereof having the dial is referred to as "back side" of the movement and a side thereof opposed to the side having the dial is referred to as "front side" of the movement. A train wheel integrated to the "front side" of the movement is referred to as "front train wheel" and a train wheel integrated to the "back side" of the movement is referred to as "back train wheel".

A position in the axis line direction of the winding stem 1110 is determined by a switch apparatus including a setting lever 1190, a yoke 1192, a yoke spring 1194 and a setting lever jumper 1196. A winding pinion 1112 is provided rotatably at a guide shaft portion of the winding stem 1110. When the winding stem 1110 is rotated in the state in which the winding stem 1110 is disposed at a first winding stem position (0-stage) on a side most proximate to the inner side of the movement along the rotational axis line, the winding pinion 1112 is rotated via rotation of a clutch wheel. A crown wheel 1114 is rotated by rotation of the winding pinion 1112. A ratchet wheel 1116 is rotated by rotation of the crown wheel 1114. By rotating the ratchet wheel 1116, a mainspring 1122 contained in a barrel complete 1120 is wound up. A center wheel & pinion 1124 is rotated by rotation of the barrel complete 1120. An escape wheel & pinion 1130 is rotated via rotation of a fourth wheel & pinion 1128, a third wheel & pinion 1126 and the center wheel & pinion 1124. The barrel complete 1120, the center wheel & pinion 1124, the third wheel & pinion 1126 and the fourth wheel & pinion 1128 constitute a front train wheel.

An escapement & speed control apparatus for controlling rotation of the front train wheel includes a balance with hairspring 1140, the escape wheel & pinion 1130 and a pallet fork 1142. The balance with hairspring 1140 includes a balance stem 1140*a*, a balance wheel 1140*b* and a hairspring 1140*c*. Based on rotation of the center wheel & pinion 1124, a cannon pinion 1150 is simultaneously rotated. A minute hand 1152 attached to the cannon pinion 1150 displays "minute". The cannon pinion 1150 is provided with a slip mechanism relative to the center pinion & wheel 1124. Based on rotation of the cannon pinion 1150, via rotation of a minute wheel, an hour wheel 1154 is rotated. An hour hand 1156 attached to the hour wheel 1154 displays "hour".

The barrel complete 1120 is supported rotatably by the main plate 1102 and a barrel bridge 1160. The center wheel & pinion 1124, the third wheel & pinion 1126, the fourth wheel & pinion 1128 and the escape wheel & pinion 1130 are supported rotatably by the main plate 1102 and a train wheel bridge 1162. The pallet fork 1142 is supported rotatably by the main plate 1102 and a pallet bridge 1164. The balance with hairspring 1140 is supported rotatably by the main plate 1102 and a balance bridge 1166.

The hairspring 1140*c* is a leaf spring in a helical (spiral) shape having a plural turn number. An inner end portion of the hairspring 1140*c* is fixed to a hairspring holder 1140*d* fixed to the balance stem 1140*a* and an outer end portion of the hairspring 1140*c* is fixed via a hairspring stud 1170*a* attached to a stud support 1170 fixed to the balance bridge 1166 by fastening screws.

A regulator 1168 is attached rotatably to the balance bridge 1166. A hairspring bridge 1168*a* and a hairspring rod 1168*b* are attached to the regulator 1168. A portion of the hairspring 1140*c* proximate to the outer end portion is disposed between the hairspring bridge 1168*a* and the hairspring rod 1168*b*.

Generally, according to a conventional representative mechanical timepiece, as shown by FIG. 8, with elapse of a duration time period of rewinding the mainspring from a state in which the mainspring has completely been wound up (fully wound state), mainspring torque is reduced. For example, in the case of FIG. 8, the mainspring torque is about 27 g.cm in the fully wound state, becomes about 23 g.cm after elapse of 20 hours from the fully wound state and becomes about 18 g.cm after elapse of 40 hours from the fully wound state.

Generally, according to a conventional representative mechanical time piece, as shown by FIG. 9, when the mainspring torque is reduced, the swing angle of the balance with hairspring is also reduced. For example, in the case of FIG. 9, when the mainspring torque is 25–28 g.cm, the swing angle of the balance with hairspring is about 240–270 degree and when the mainspring torque is 20–25 g.cm, the swing angle of the balance with hairspring is about 180–240 degree.

In reference to FIG. 10, there is shown a transitional change of instantaneous rate with regard to swing angle of a balance with hairspring according to a conventional representative mechanical time piece (numerical value indicating accuracy of time piece). In this case, the "instantaneous rate" is defined as "a value indicating gain or loss of a mechanical time piece after elapse of one day after the mechanical time piece is assumed to be left for one day while maintaining state or environment of swing angle of a balance with hairspring or the like when the rate is measured". In the case of FIG. 10, when a swing angle of a balance with hairspring is equal to or larger than 240 degree or is equal to or smaller than 200 degree, the instantaneous rate is retarded.

For example, according to a conventional representative time piece, as shown by FIG. 10, when the swing angle of the balance with hairspring falls in a range of about 200 through 240 degree, the instantaneous rate is about 0 through 5 seconds/day (gain of 0 through 5 seconds per day), however, when the swing angle of the balance with hairspring is about 170 degree, the instantaneous rate becomes about −20 seconds/day (loss of about 20 seconds per day).

In reference to FIG. 12, there is shown a transitional change of elapse time and instantaneous rate when a mainspring is rewound from a fully wound state in a conventional representative mechanical time piece. In this case, in the conventional mechanical time piece, "rate" indicating gain of the timepiece or loss of the time piece per day, is provided by integrating instantaneous rate with regard to elapse time of rewinding the balance with hairspring from a fully wound state, which is indicated in FIG. 12 by an extremely slender line, over 24 hours.

Generally, according to the conventional mechanical timepiece, with elapse of duration time period of rewinding the mainspring from the fully wound state, the mainspring torque is reduced, the swing angle of the balance with hairspring is also reduced and accordingly, the instantaneous rate is retarded. Therefore, according to the conventional mechanical timepiece, by estimating loss of the time piece after elapse of the duration time period of 24 hours, instantaneous rate when the mainspring is brought into the fully wound state, is previously gained and previously adjusted such that the "rate" indicating gain of the time piece or loss of the time piece per day becomes positive.

For example, according to the conventional representative time piece, as shown by the extremely slender line in FIG. 12, although in the fully wound state, the instantaneous rate is about 3 seconds/day (gain of about 3 seconds per day), after elapse of 20 hours from the fully wound state, the instantaneous rate becomes about −3 seconds/day (loss of about 3 seconds per day), after elapse of 24 hours from the fully wound state, the instantaneous rate becomes about −8 seconds per day (loss of about 8 seconds per day) and after elapse of 30 hours from the fully wound state, the instantaneous rate becomes about −16 seconds/day (loss of about 16 seconds per day).

Further, as a conventional apparatus of adjusting a swing angle of a balance with hairspring, there is disclosed in Japanese Utility Model Laid-Open No. 41675/1979, a constitution having a swing angle adjusting plate exerting braking force to a balance with hairspring by generating eddy current at each time of pivotal approach of a magnet of the balance with hairspring.

Further, as shown by FIG. 36, a conventional coreless motor 2100 is provided with a shaft 2102, a magnet yoke 2104 fixed to the shaft 2102 and a drive magnet 2106 fixed to the magnet yoke 2104. A stator yoke 2110 is provided rotatably to the shaft 2102 via a bearing 2112. A printed circuit board 2114 is fixed to the stator yoke 2110. A drive coil 2116 is fixed to the printed circuit board 2114 to be opposed to the drive magnet 2106 and spaced apart therefrom. By applying current to the drive coil 2116, the drive magnet 2106, the magnet yoke 2104 and the shaft 2102 are constituted to rotate.

It is an object of the invention to provide a mechanical time piece having a balance rotational angle control mechanism capable of controlling a swing angle of a balance with hairspring to fall in a constant range.

Further, it is an object of the invention to provide a mechanical time piece having excellent accuracy in which a change in a rate is in considerable even after elapse of an elapse time period from a fully wound state of a mainspring by providing a novel balance rotational angle control mechanism.

Further, it is an object of the invention to provide a mechanical time piece constituted such that a balance rotational angle control mechanism includes a balance magnet provided at a balance with hairspring and a coil unit arranged to relate to the balance magnet and constituted such that fabrication and assembly of parts are facilitated.

SUMMARY OF THE INVENTION

According to an aspect of the invention, there is provided a mechanical time piece characterized in that in a mechanical time piece having a main plate constituting a base plate of the mechanical time piece, a mainspring constituting a power source of the mechanical time piece, a front train wheel rotated by a rotational force when the mainspring is rewound and an escapement & speed control apparatus for controlling rotation of the front train wheel in which the escapement & speed control apparatus includes a balance with hairspring alternately repeating right rotation and left rotation, an escape wheel & pinion rotated based on the rotation of the front train wheel and a pallet fork for controlling rotation of the escape wheel & pinion based on operation of the balance with hairspring, the mechanical time piece comprising a switch mechanism constituted to output a signal of ON when a rotational angle of the balance with hairspring becomes equal to or larger than a predetermined threshold and output a signal of OFF when the rotational angle of the balance with hairspring does not exceed the threshold, and a balance rotational angle control mechanism constituted to exert a force for restraining rotation of the balance with hairspring to the balance with hairspring when the switch mechanism outputs the signal of ON.

According to the mechanical time piece of the aspect of the invention, the switch mechanism is constituted to output the signal of ON when a hairspring provided at the balance with hairspring is brought into contact with terminal members constituting a switch lever.

Further, according to the mechanical time piece of the aspect of the invention, the balance rotational angle control mechanism includes a balance magnet provided to the balance with hairspring and a plurality of coils arranged to be capable of exerting a magnetic force to the balance magnet and the coils are constituted to exert the magnetic force to the balance magnet to thereby restrain the rotation of the balance with hairspring when the switch mechanism outputs the signal of ON and not to exert the magnetic force to the balance magnet when the switch mechanism outputs the signal of OFF.

Further, the mechanical time piece of the invention is provided with a circuit board having patterns for conducting the plurality of coils.

By using the balance rotational angle control mechanism constituted in this way, the rotational angle of the balance with hairspring of the mechanical time piece can effectively be controlled, thereby, accuracy of the mechanical time piece can be promoted.

Further, according to the mechanical time piece of the invention, it is preferable that wiring portions of the plurality of coils are arranged on a side of a main plate of the circuit board.

Further, according to the mechanical time piece of the invention, it is preferable that the plurality of coils are attached to a coil bridge and the circuit board is attached to the coil bridge and the coil bridge is guided by a bearing member provided at the main plate.

Further, according to the mechanical time piece of the invention, it is preferable that the plurality of coils are attached to coil bridges provided respectively separately, the coil bridges are respectively attached to the circuit board and the coil bridges are guided by the guide holes respectively provided at the main plate.

Further, according to the mechanical time piece of the invention, it is preferable that the circuit board is provided with patterns for conducting the plurality of coils on one side thereof and is provided with patterns for connecting lead wires for conducting the switch mechanism on other side thereof.

Further, according to the mechanical time piece of the invention, it is preferable that the plurality of coils are connected in series by the patterns provided to the circuit board.

By constituting in this way, the plurality of coils can be arranged efficiently in a small space and the plurality of coils can firmly be conducted.

Further, according to the mechanical time piece of the invention, it is preferable that the switch mechanism includes a first terminal member and a second terminal member and is further provided with an adjusting apparatus for changing an interval between the first terminal member and the second terminal member.

Further, according to the mechanical time piece of the invention, it is preferable that the switch mechanism includes a first terminal member and a second terminal member and is further provided with an adjusting apparatus for simultaneously moving the first terminal member and the second terminal member relative to a rotational center of the balance with hairspring.

By constituting in this way, the positions of the first terminal member and the second terminal member relative to the portion proximate to the outer end portion of the hairspring and the interval between the first terminal member and the second terminal member can effectively be adjusted.

DETAILED DESCRIPTION OF THE PREFERRED EMBODIMENTS

An explanation will be given of embodiments of a mechanical time piece according to the invention with reference to the drawings as follows.

(1) Embodiment 1 of Mechanical Time Piece According to the Invention

Figure 1:
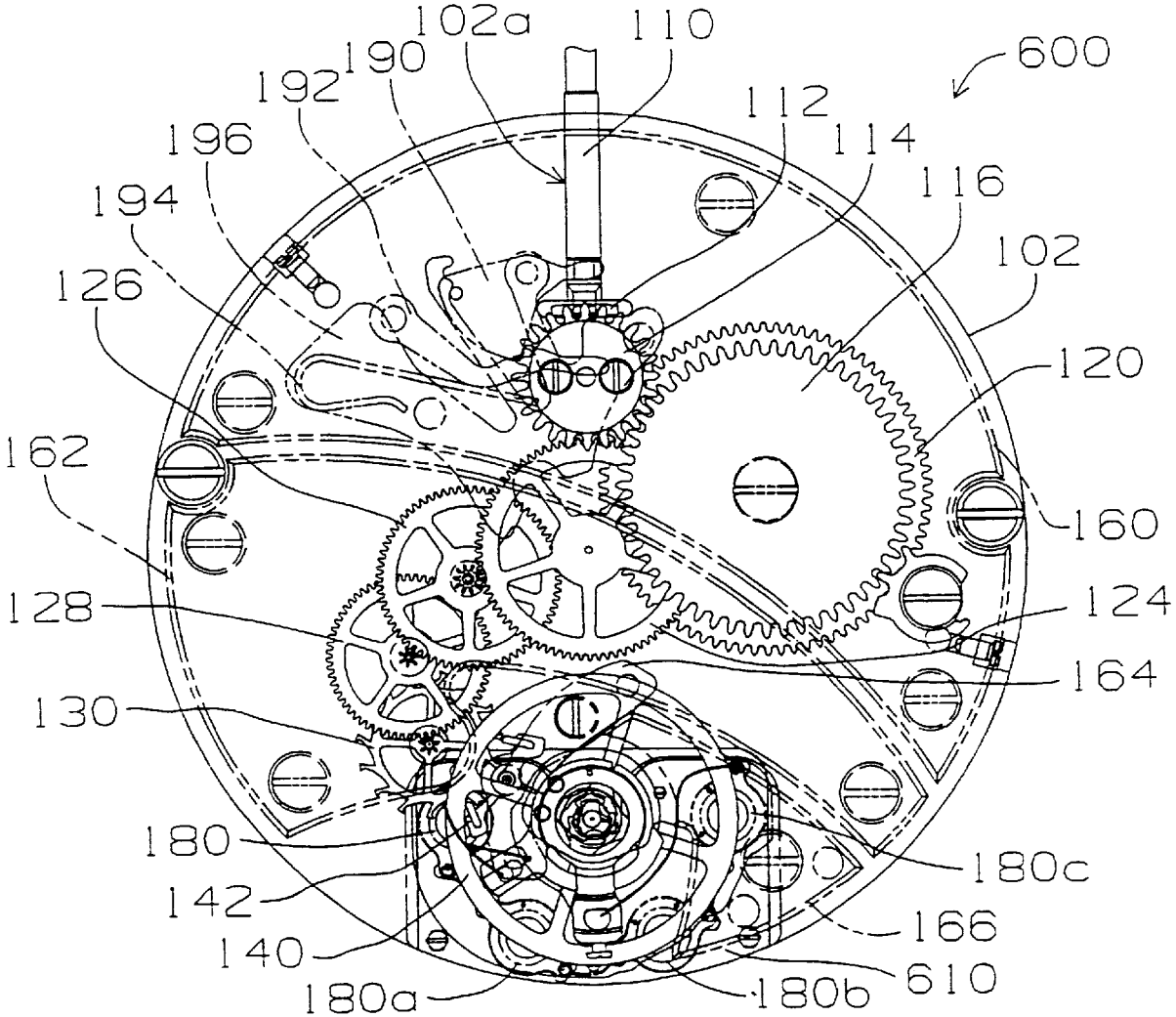
FIG. 1 is a plane view showing an outline shape of a front side of a movement according to Embodiment 1 of a mechanical time piece of the invention (in FIG. 1, portions of parts are omitted and bridge members are indicated by imaginary lines).
Figure 2:
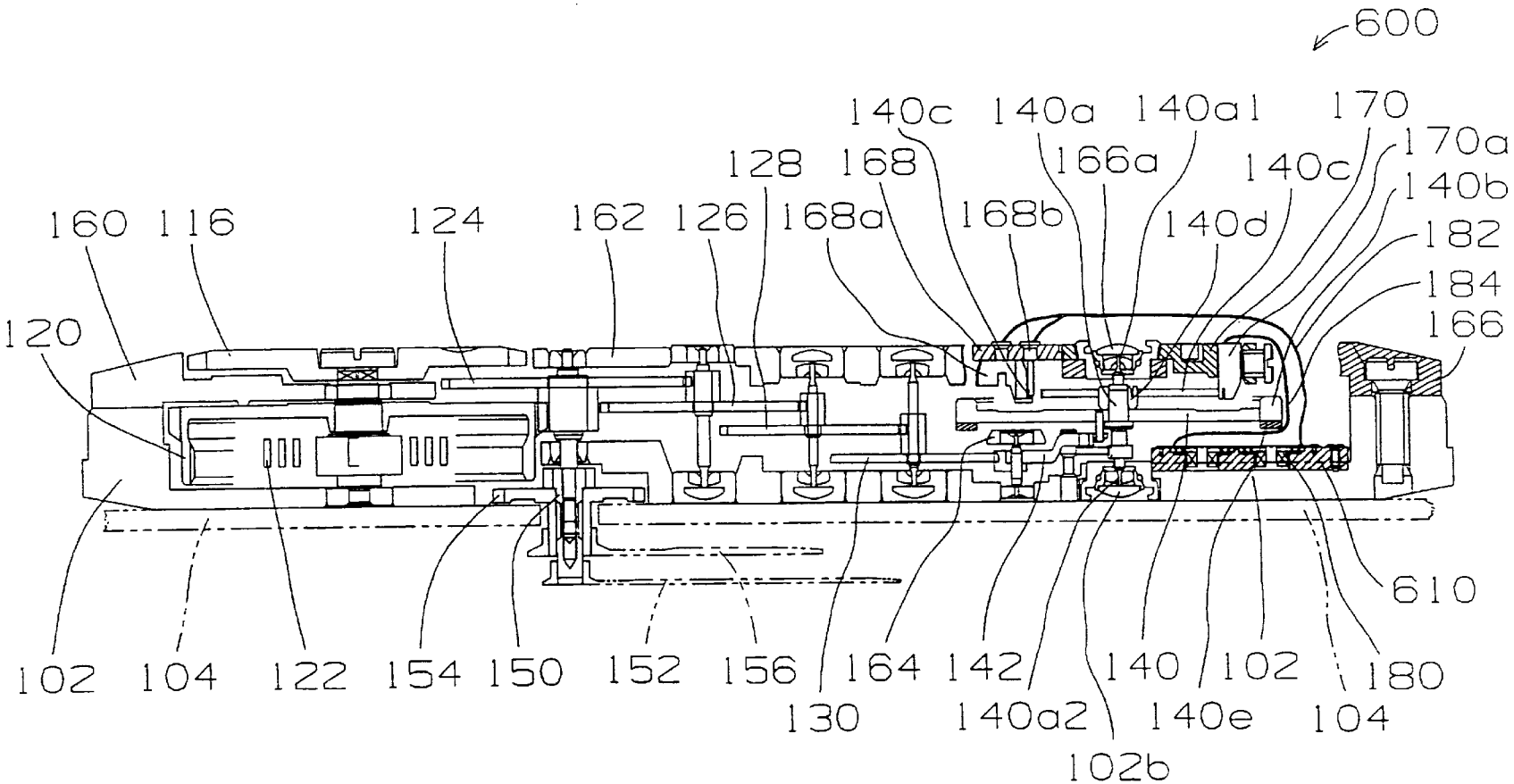
FIG. 2 is an outline partial sectional view of the movement according to Embodiment 1 of the mechanical time piece of the invention (in FIG. 2, portions of parts are omitted).

(1.1) Constitution of Movement of Mechanical Time Piece According to the Invention In reference to. FIG. 1 and FIG. 2, according to an embodiment of a mechanical time piece of the invention, a movement (machine body) 600 of the mechanical time piece is provided with a main plate 102 constituting a base plate of the movement. A winding stem 110 is rotatably integrated to a winding stem guide hole 102*a* of the main plate 102. A dial 104 (shown by FIG. 2 by imaginary line) is attached to the movement 600.

The winding stem 110 is provided with a square portion and a guide shaft portion. A clutch wheel (not illustrated) is integrated to the square portion of the winding stem 110. That is, the clutch wheel is provided with a rotational axis line the same as a rotational axis line of the winding stem 110. That is, the clutch wheel is provided with a square hole and is provided to rotate based on rotation of the winding stem 110 by fitting the square hole to the square portion of the winding stem 110. The clutch wheel is provided with tooth A and tooth B. The tooth A is provided at an end portion of the clutch wheel proximate to the center of the movement. The tooth B is provided at an end portion of the clutch wheel proximate to an outer side of the movement.

The movement 600 is provided with a switch apparatus for determining a position of the winding stem 110 in the axial line direction. The switch apparatus includes a setting lever 190, a yoke 192, a yoke spring 194 and a setting lever jumper 196. Based on rotation of the clutch wheel, the position in the rotational axis line of the winding stem 110 is determined. Based on rotation of the yoke 192, a position in the rotational axis line direction of the clutch wheel is determined. Based on rotation of the setting lever, the yoke is positioned to two positions in the rotational direction.

A winding pinion 112 is provided rotatably at the guide shaft portion of the winding stem 110. When the winding stem 110 is rotated in a state in which the winding stem 110 is disposed at a first winding stem position (0-stage) most proximate to the inner side of the movement along the rotational axis line, the winding pinion 112 is constituted to rotate via rotation of the clutch wheel. A crown wheel 114 is constituted to rotate by rotation of the winding pinion 112. A ratchet wheel 116 is constituted to rotate by rotation of the crown wheel 114.

The movement 600 is provided with a mainspring 122 contained in a barrel complete 120 as its power source. The mainspring 122 is made of an elastic material having spring performance such as iron. By rotating the ratchet wheel 116, the mainspring 122 is constituted to be capable of being wound up.

A center wheel & pinion 124 is constituted to rotate by rotation of the barrel complete 120. A third wheel & pinion 126 is constituted to rotate based on rotation of the center wheel & pinion 124. A fourth wheel & pinion 128 is constituted to rotate based on rotation of the third wheel & pinion 126. An escape wheel & pinion 130 is constituted to rotate based on rotation of the fourth wheel & pinion 128. The barrel complete 120, the center wheel & pinion 124, the third wheel & pinion 126 and the fourth wheel & pinion 128 constitute a front train wheel.

The movement 600 is provided with an escapement & speed control apparatus for controlling rotation of the front train wheel. The escapement & speed control apparatus includes a balance with hairspring 140 repeating right rotation and left rotation at a constant period, the escape wheel & pinion 130 rotating based on rotation of the front train wheel and a pallet fork 142 for controlling rotation of the escape wheel & pinion 130 based on operation of the balance with hairspring 140.

The balance with hairspring 140 includes a balance stem 140*a*, a balance wheel 140*b* and a hairspring 140*c*. The hairspring 140*c* is made of an elastic material having spring performance such as "elinbar". That is, the hairspring 140*c* is made of an electrically conducting material of metal.

Based on rotation of the center wheel & pinion 124, a cannon pinion 150 is simultaneously rotated. A minute hand 152 attached to the cannon pinion 150 is constituted to display "minute". The cannon pinion 150 is provided with a slip mechanism having a predetermined slip torque relative to the center wheel & pinion 124.

Based on rotation of the cannon pinion 150, a minute wheel (not illustrated) is rotated. Based on rotation of the minute wheel, an hour wheel 154 is rotated. An hour hand 156 attached to the hour wheel 154 is constituted to display "hour".

The barrel complete 120 is supported rotatably by the main plate 102 and a barrel bridge 160. The center wheel & pinion 124, the third wheel & pinion 126, the fourth wheel & pinion 128 and the escape wheel & pinion 130 are supported rotatably by the main plate 102 and a train wheel bridge 162. The pallet fork 142 is supported rotatably by the main plate 102 and a pallet bridge 164.

The balance with hairspring 140 is supported rotatably by the main plate 102 and a balance bridge 166. That is, an upper mortise 140*a*l of the balance stem 140*a* is supported rotatably by a balance upper bearing 166*a* fixed to the balance bridge 166. The balance upper bearing 166*a* includes a balance upper hole jewel and a balance upper cap jewel. The balance upper hole jewel and the balance upper cap jewel are made of an insulating material such as ruby.

A lower mortise 140*a*2 of the balance stem 140*a* is supported rotatably by a balance lower bearing 102*b* fixed to the main plate 102. The balance lower bearing 102*b* includes a balance lower hole jewel and a balance lower cap jewel. The balance lower hole jewel and the balance lower cap jewel are made of an insulating material such as ruby.

The hairspring 140*c* is a leaf spring in a helical (spiral) shape having a plural turn number. An inner end portion of the hairspring 140*c* is fixed to a hairspring holder 140*d* fixed to the balance stem 140*a* and an outer end portion of the hairspring 140*c* is fixed by screws via a hairspring holder 170*a* attached to a hairspring holder cap 170 rotatably fixed to the balance bridge 166. The balance bridge 166 is made of an electrically conductive material of metal such as brass. The hairspring holder cap 170 is made of an eclectically conductive material of metal such as iron.

(1.2) Constitution of Switch Mechanism

Next, an explanation will be given of a switch mechanism of the mechanical time piece according to the invention.

In reference to FIG. 1 and FIG. 2, a switch lever 168 is rotatably attached to the balance bridge 166. A first terminal member 168*a* and a second terminal member 168*b* are attached to the switch lever 168. The switch lever 168 is attached to the balance bridge 166 and is rotatably attached thereto centering on the rotational center of the balance with hairspring 140. The switch lever 168 is formed by an insulating material of plastic such as polycarbonate. The first terminal member 168*a* and the second terminal member 168*b* are fabricated by a conductive material of a metal such as brass. A portion of the hairspring 140*c* proximate to an outer end portion thereof is disposed between the first terminal member 168*a* and the second terminal member 168*b*.

In reference to FIG. 1 through FIG. 4, a circuit unit 610 is attached to a face of a front side of the main plate 102. The circuit unit 610 includes a circuit board 612 and a coil unit 614. The coil unit 614 includes a coil bridge 616 and four coils 180, 180*a*, 180*b* and 180*c*. In a state in which the coils 180, 180*a*, 180*b* and 180*c* are arranged to be opposed to a face of the balance wheel 140*b* on the side of the main plate, the coil unit 614 is attached to the face of the main plate 102 on the front side.

Although a number of the coils is, for example, four as shown by FIG. 1 through FIG. 4, the number may be one, may be two, may be three or may be four or more.

The circuit board 612 is fixed to a face of the coil bridge 616 on the side opposed to the balance wheel 140*b* by circuit board fixing screws 618. The circuit unit 610 is attached to the face on the front side of the main plate 102 by circuit unit fixing screws 620. That is, as shown by FIG. 1 through FIG. 4, the coil unit 614 is attached to the face on the front side of the main plate 102 in a state in which the fourcoils 180, 180*a*, 180*b* and 180*c* are respectively arranged on the side of the main plate 102 of the circuit board 612 and in a state in which the circuit board 612 is opposed to the face of the balance wheel 140*b* opposed to the main plate 102.

Figure 21:
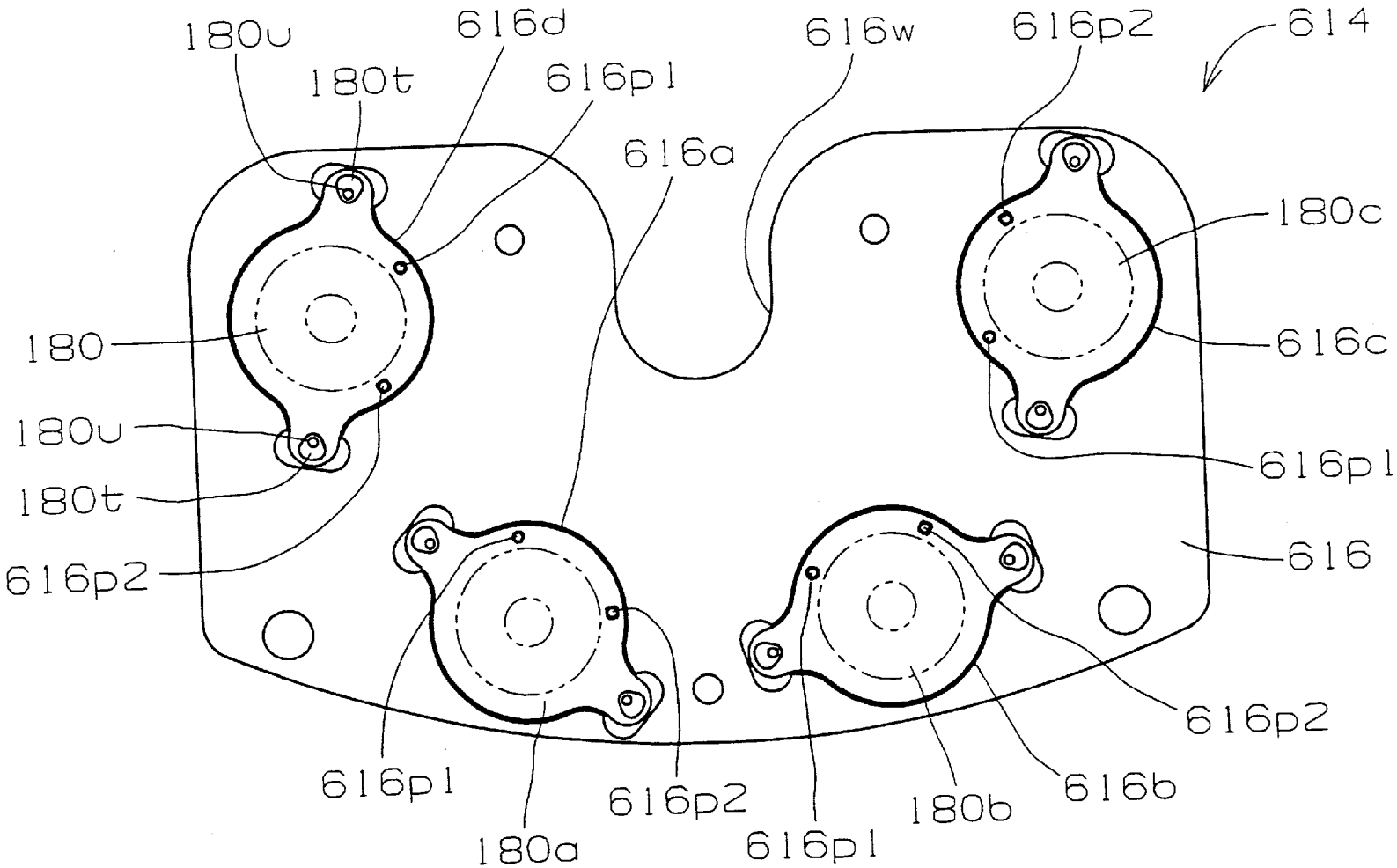
FIG. 21 is a front plane view showing an outline shape of a coil unit according to Embodiment 1 of a mechanical time piece of the invention.
Figure 22:
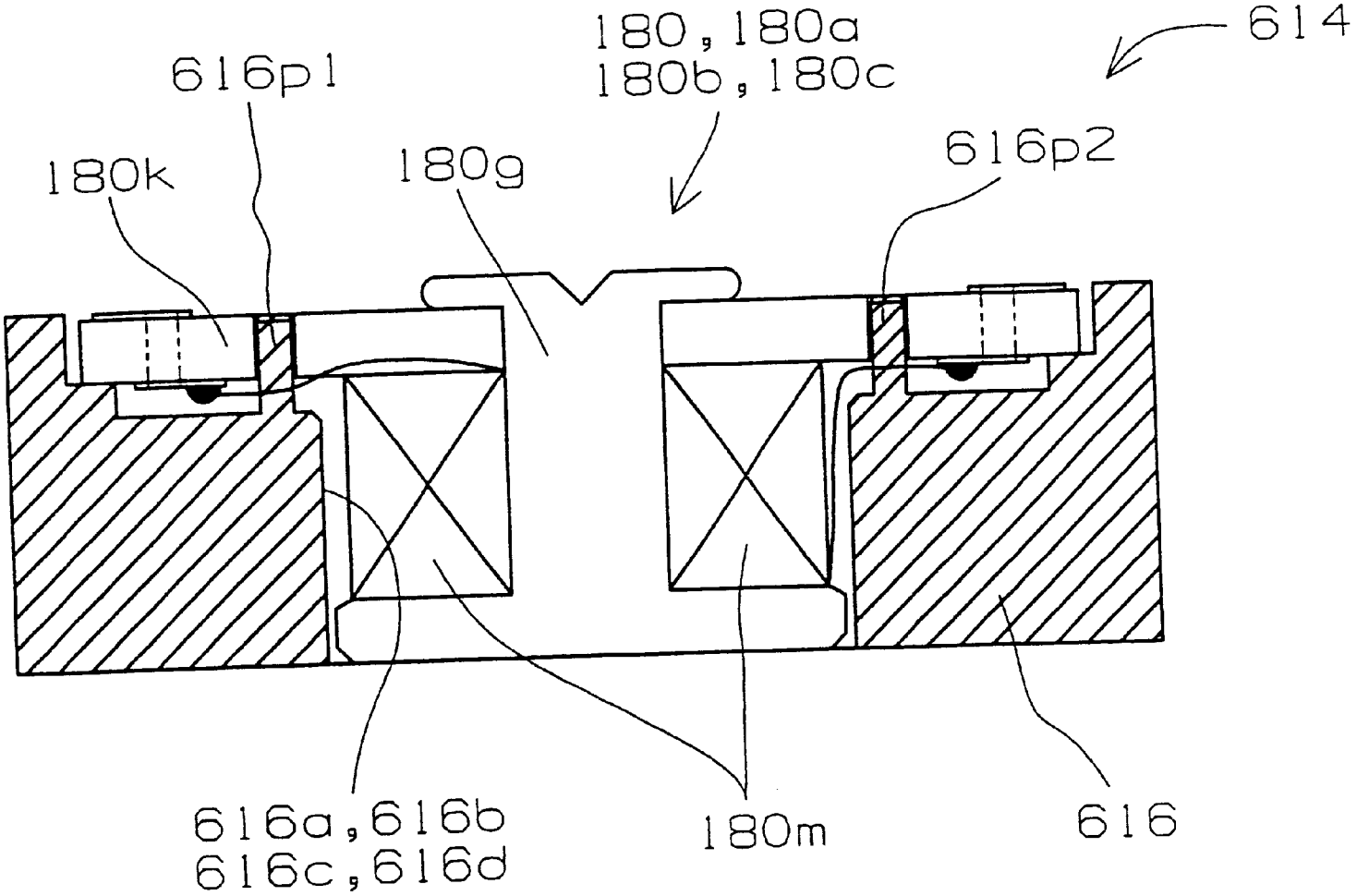
FIG. 22 is a sectional view showing the outline shape of the coil unit according to Embodiment 1 of the mechanical time piece of the invention.

In reference to FIG. 21 and FIG. 22, the coils 180, 180*a*, 180*b* and 180*c* are respectively arranged to the coil bridge 616 such that wiring portions 180*m* are contained in opening portions 616*d*, 616*a*, 616*b* and 616*c* of the coil bridge 616.

Four sets of guide pins 616*p*1 and 616*p*2 are provided at the coil bridge 616. One set of the guide pins 616*p*1 and 616*p*2 guide the coil 180, other set of the guide pins 616*p*1 and 616*p*2 guide the coil 180*a*, other set of the guide pins 616*p*1 and 616*p*2 guide the coil 180*b* and other set of the guide pins 616*p*1 and 616*p*2 guide the coil 180*c*.

Figure 23:
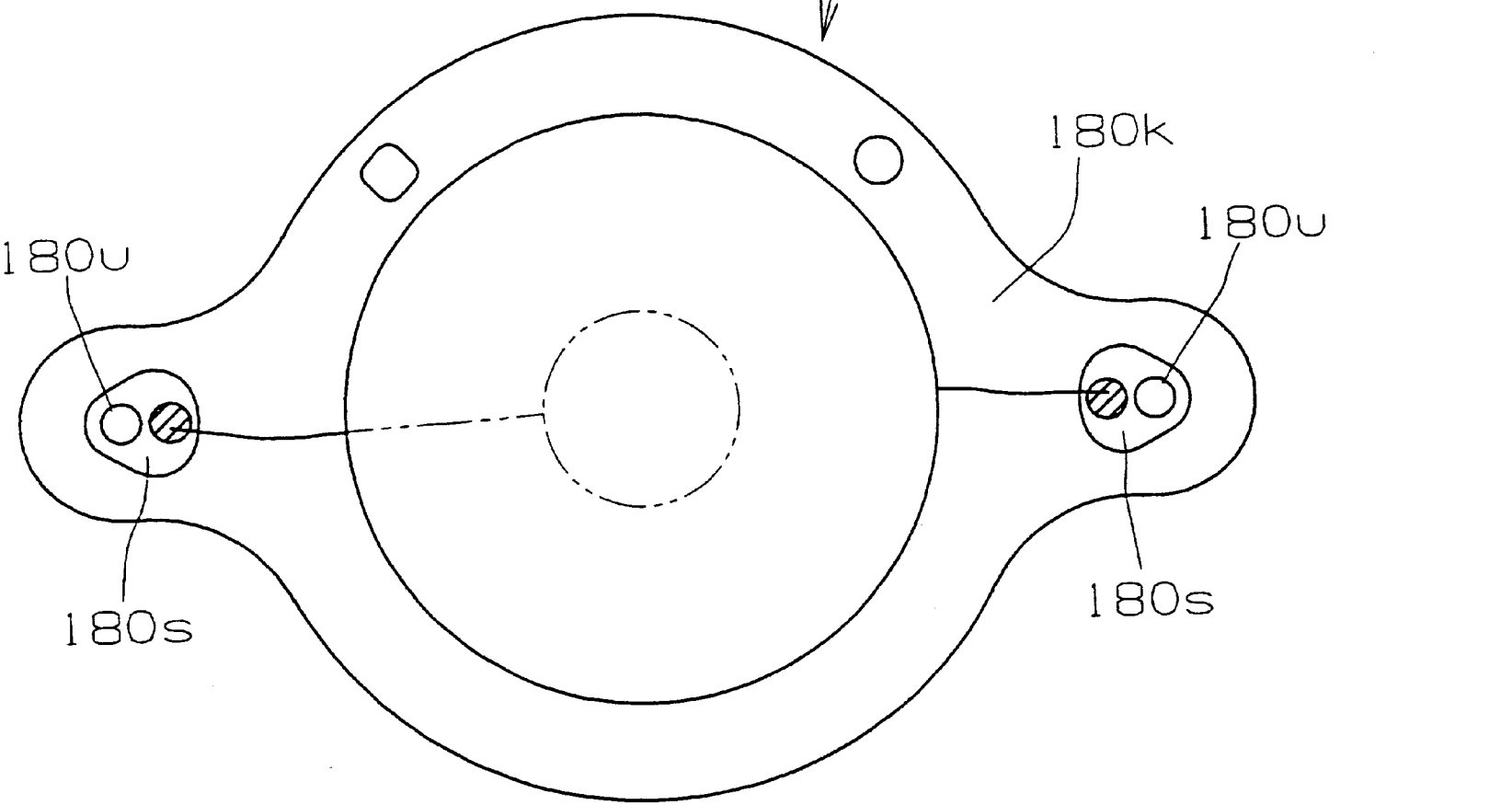
FIG. 23 is a rear plane view showing an outline shape of a coil according to Embodiment 1 of the mechanical time piece of the invention.
Figure 24:
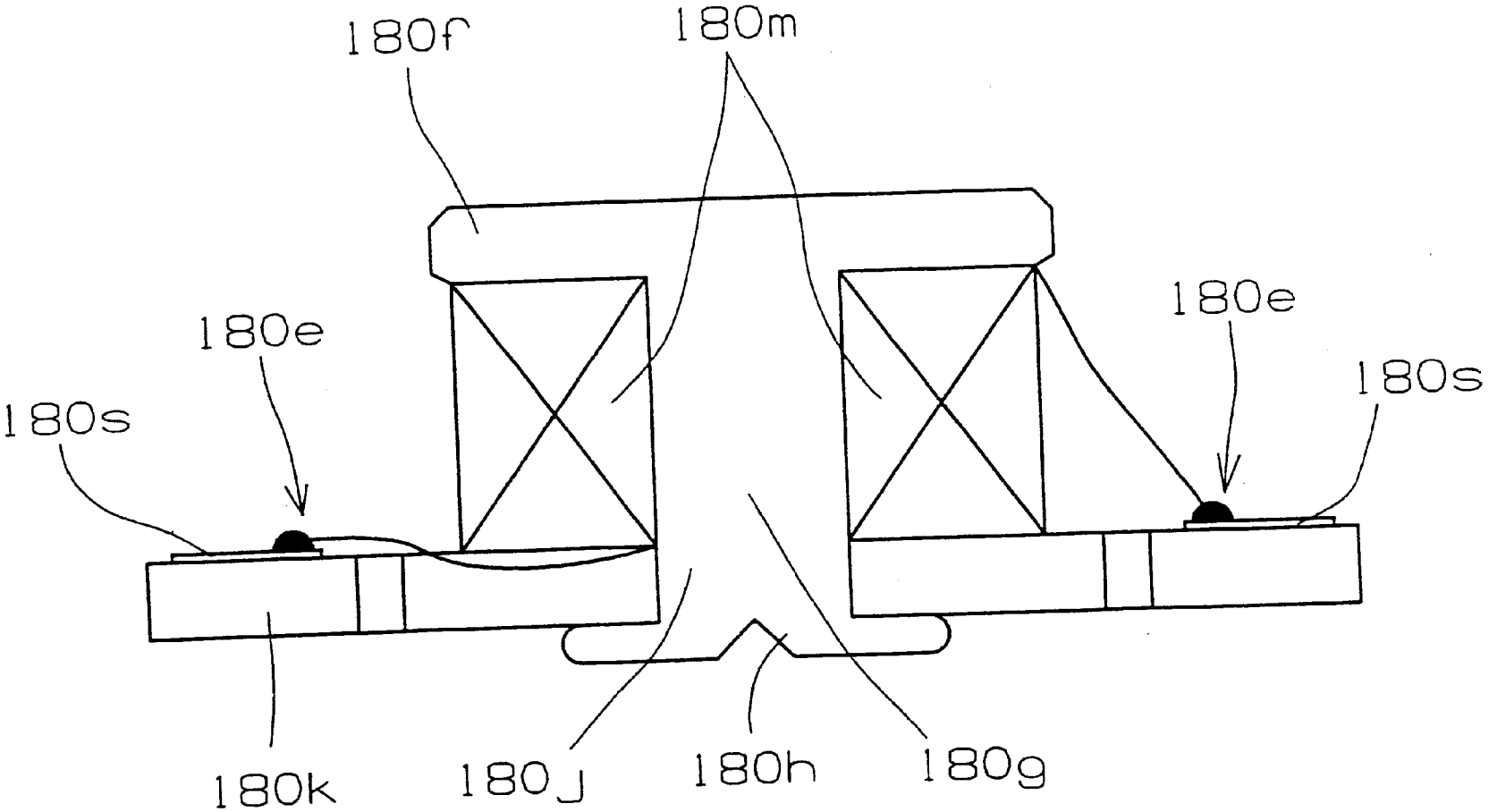
FIG. 24 is a sectional view showing the outline shape of the coil according to Embodiment 1 of the mechanical time piece of the invention.

With reference to FIG. 23 and FIG. 24, each of the coils 180, 180*a*, 180*b*, 180*c* is provided with a coil stem 180*g* is constituted by a nonmagnetic material such as plastic or brass. The coil stem 180*g* is provided with a flange portion 180*f* at one end thereof, a front end portion 180*h* at other end thereof penetrates the coil board 180*k* and is fixed to the front side or the soil board 180*k* by caulking or the like.

The winding portion 180*m* is provided at an outer periphery of a shaft portion 180*j* of the coil stem 180*g*. Two terminals 180*e* of the winding portion 180*m* are fixed to back side patterns 180*s* arranged at the coil board 180*k* on the wiring side. Fixing of the terminal 180*e* of the wiring portion 180*m* may be carried out by welding, soldering adhering by using a conductive adhering agent or the like. The coil board 180*k* is provided with front side patterns 180*t*. The front side patterns 180*t* and the back side patterns 180*s* are respectively conducted individually by through holes 180*u*. Conduction of the front side pattern 180*t* and the backside pattern 180*s* may be carried out by through hole plating provided to the through hole 180*u*.

Figure 33:
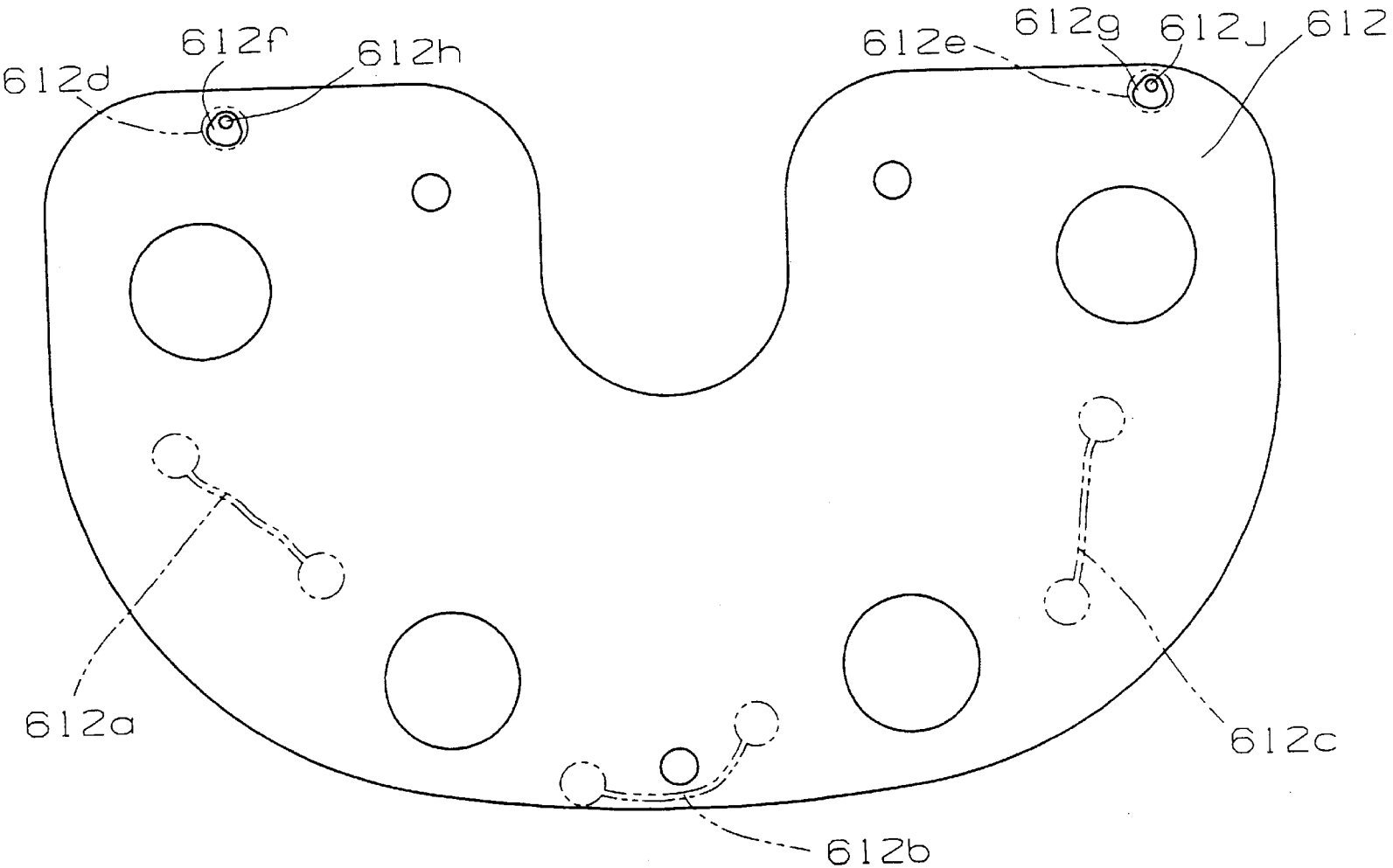
FIG. 33 is a front plane view showing the outline shape of the circuit board used in Embodiment 1 of the mechanical time piece of the invention.

In this case, in reference to FIG. 33, the back side of the circuit board 612 is provided with a first coil conducting pattern 612*a* provided for conducting in series the front side pattern 180*t* of the coil board 180*k* conducted to one terminal of the coil 180 and the front side pattern 180*t* of the coil board 180*k* conducted to one terminal of the coil 180*a*, a second coil conducting pattern 612*b* provided for conducting in series the front side pattern 180*t* of the coil board 180*k* conducted to other terminal of the coil 180*a* and the front side pattern 180*t* of the coil board 180*k* conducted to one terminal of the coil 180*b*, and a third coil conducting pattern 612*c* provided for conducting in series the front side pattern 180*t* of the coil board 180*k* conducted to other terminal of the coil 180*b* and the front side pattern 180*t* of the coil board 180*k* conducted to one terminal of the coil 180*c*.

Therefore, according to the constitution shown by FIG. 1 through FIG. 4, the coils 180, 180*a*, 180*b* and 180*c* are conducted in series by three of the coil conducting patterns 612*a*, 612*b* and 612*c* provided at the circuit board 612.

Further, the back side of the circuit board 612 is provided with a first coil contact pattern 612*d* for contacting the front side pattern 180*t* of the coil board 180*k* conducted to other terminal of the coil 180 and a second coil contact pattern 612*e* for contacting the front side pattern 180*t* of the coil board 180*k* conducted to other terminal of the coil 180*c*.

The circuit board 612 is further provided with a first lead connecting pattern 612*f* and a second lead connecting pattern 612*g* on its front side. The first lead connecting pattern 612*f* and the first coil contact pattern 612*d* are conducted by a first through hole 612*h*. The second lead connecting pattern 612*g* and the second coil contact pattern 612*e* are conducted by a second through hole 612*j*. Conduction of the lead connecting pattern provided on the front side of the circuit board 612 and the coil contact pattern provided on the back side of the circuit board 612 may be carried out by through hole plating provided at the through hole.

When the circuit unit 610 is attached to the main plate 102, the operation may be carried out by moving the circuit unit 610 in parallel with the surface of the main plate 102 such that a guiding semicircular arc portion 616*w* (refer to FIG. 21) of the coil bridge 616 is brought into contact with an outer peripheral portion of the balance lower bearing 102*b* fixed to the main plate 102. The balance lower bearing 102*b* constitutes a bearing member provided at the main plate 102.

According to the constitution, the circuit unit 610 can be attached to the main plate 102 after attaching the balance with hairspring 140 to the movement.

Figure 25:
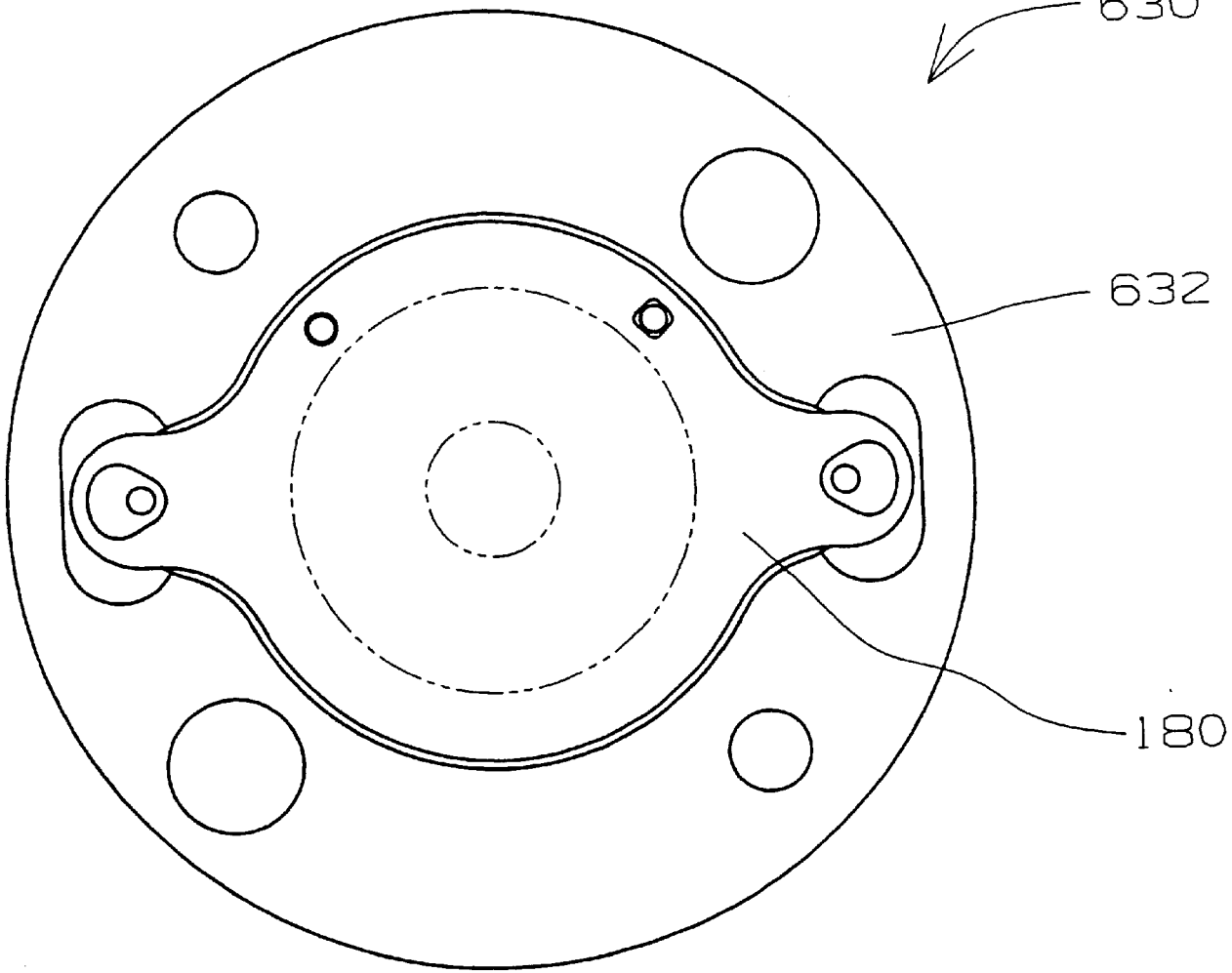
FIG. 25 is a front plane view showing an outline shape of a modified mode of a coil unit according to Embodiment 1 of a mechanical time piece of the invention.

As a modified example, in reference to FIG. 25, a coil unit 630 includes a coil bridge 632 and the coil 180. An outer peripheral shape of the coil bridge 632 is circular.

Figure 34:
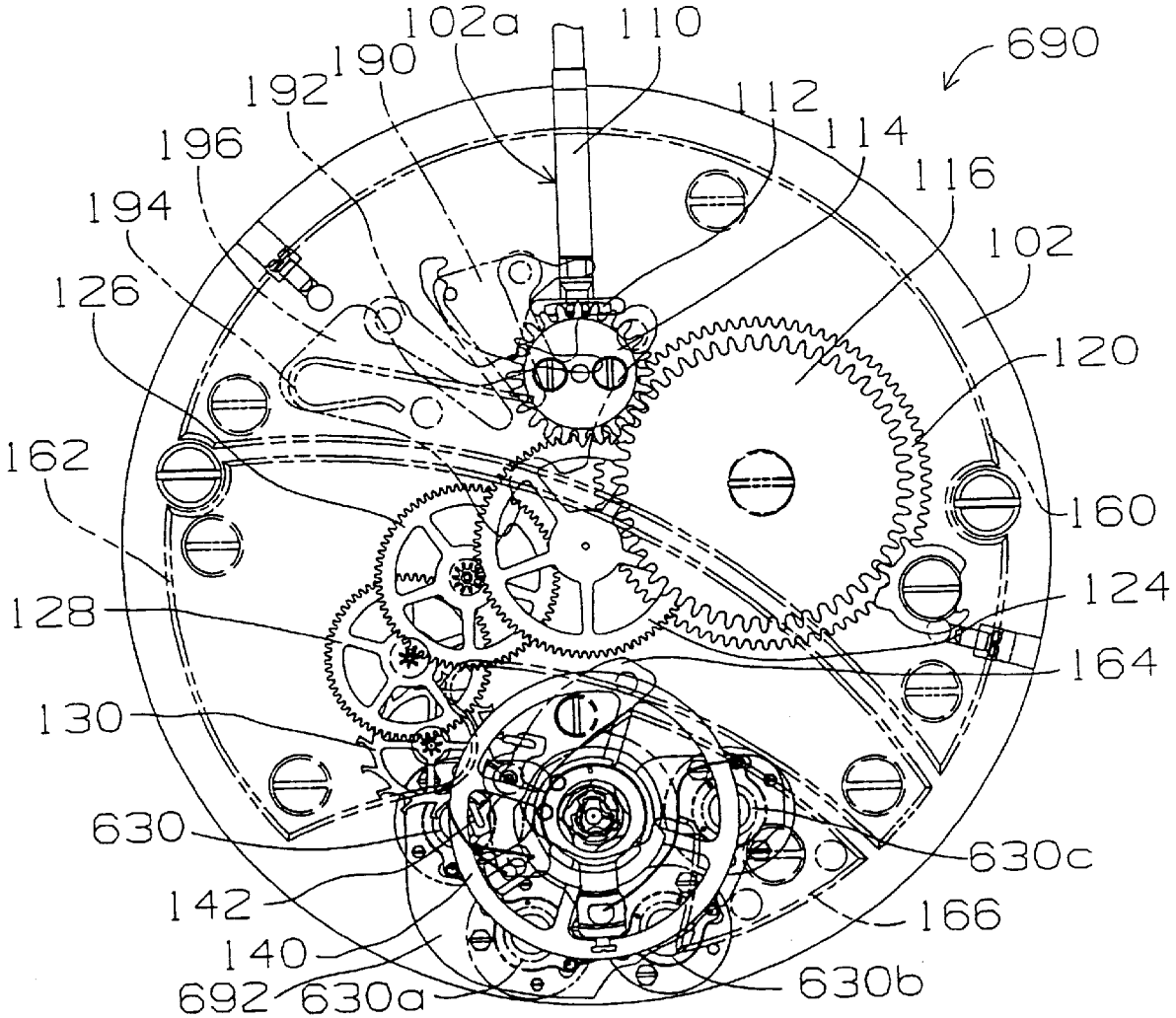
FIG. 34 is a plane view showing an outline shape of a front side of a movement according to a modified example of Embodiment 1 of the mechanical time piece of the invention (in FIG. 34, portions of parts are omitted and bridge members are indicated by imaginary lines).
Figure 35:
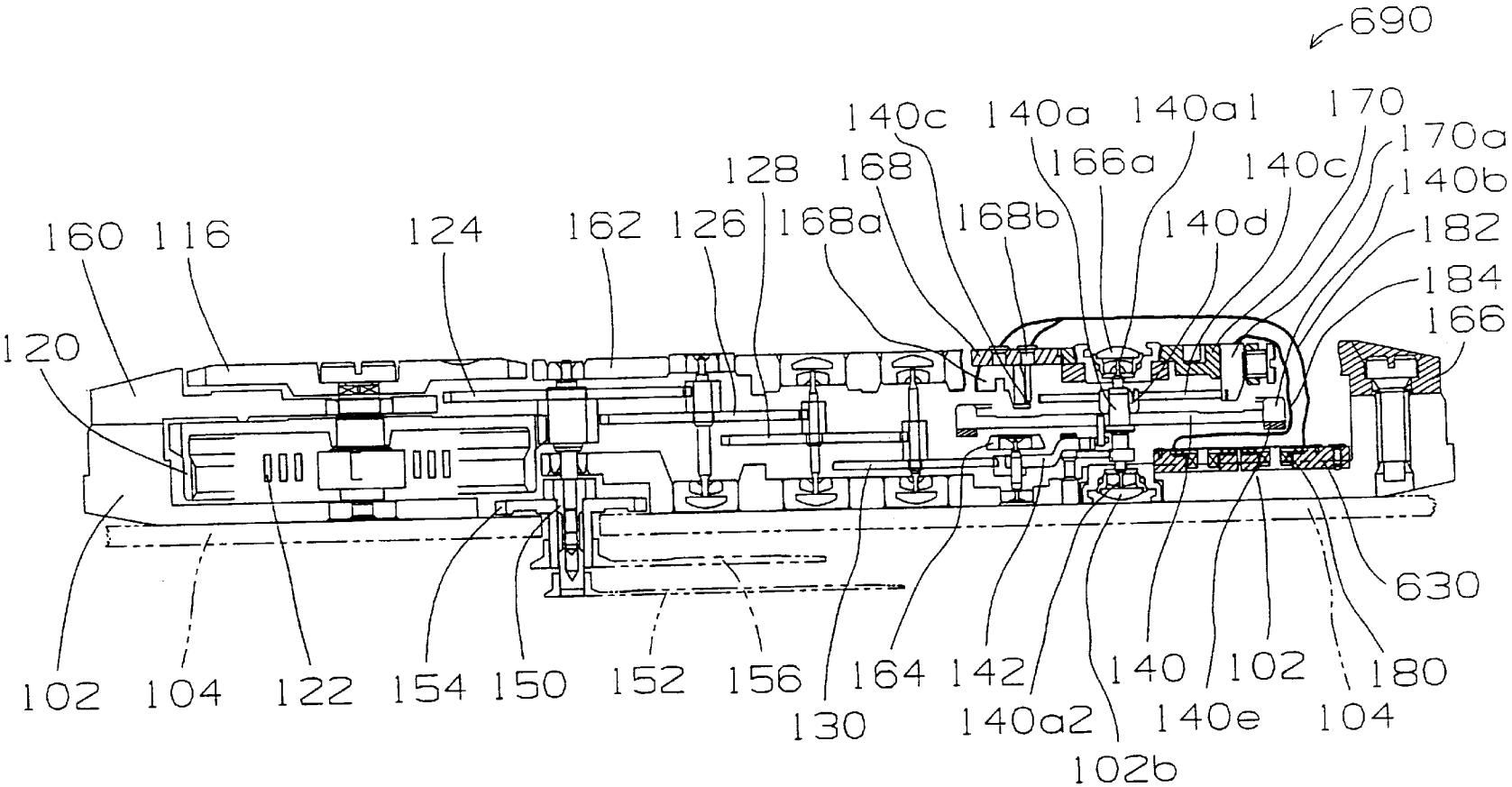
FIG. 35 is an outline partial sectional view of the movement according to the modified example of Embodiment 1 of the mechanical time piece of the invention (in FIG. 35, portions of parts are omitted).
Figure 36:
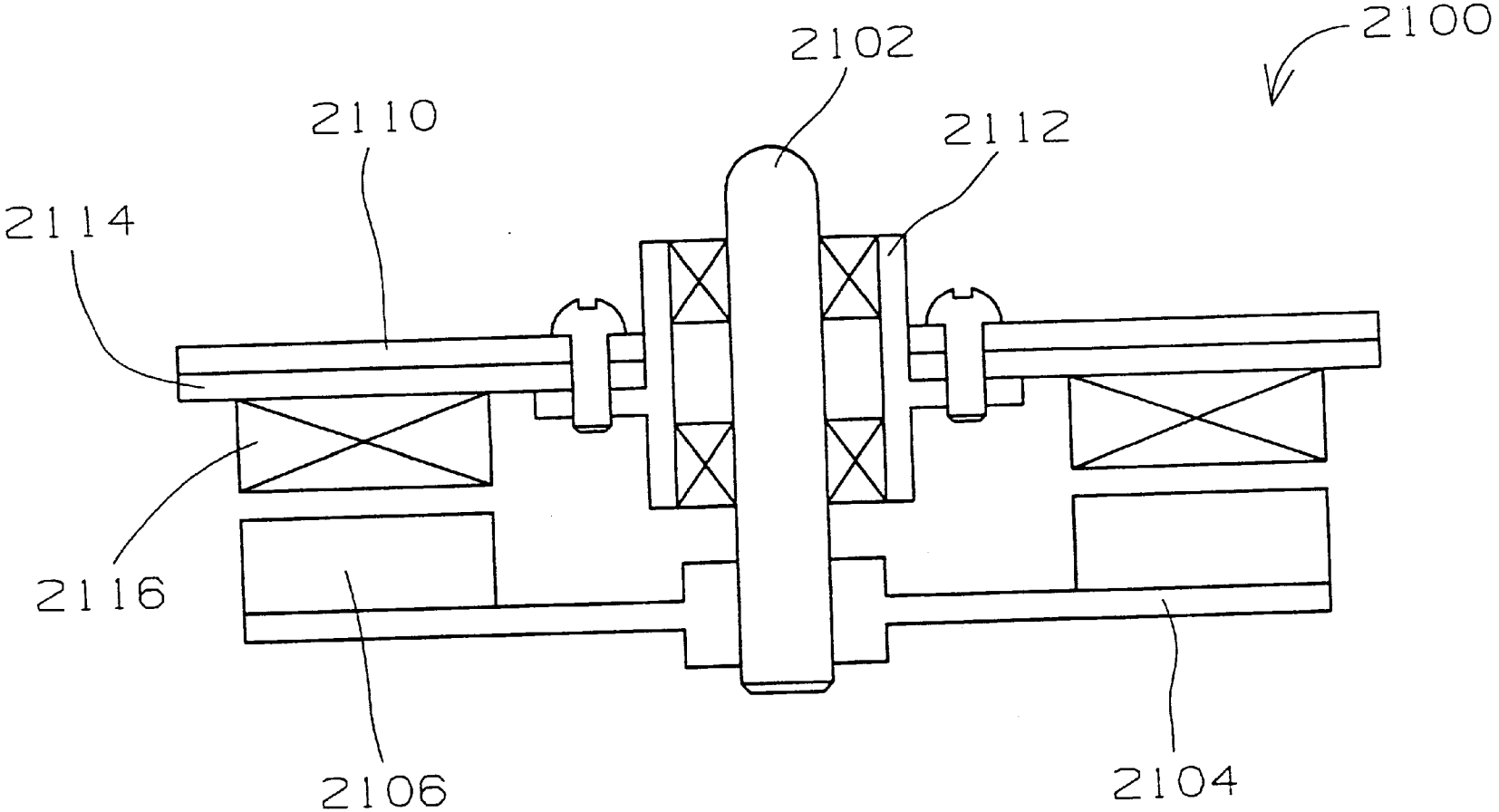
FIG. 36 is a sectional view showing an outline shape of a conventional motor.

In this case, in reference to FIG. 34 and FIG. 35, according to a movement 690, the circuit board 612 is fixed to faces of the respective coil bridges 632 of four of the coil units 630 opposed to the balance wheel 140*b* by the circuit board fixing screws 618. The circuit unit 610 is attached to the face of the main plate 102 on the front side by the circuit unit fixing screws 620. That is, four of the coil units 630 are attached to the face of the main plate 102 on the front side in the state in which four of the coils 180 are respectively arranged on the side of the main plate 102 of the circuit board 692 such that the circuit board 692 is opposed to the face of the balance wheel 140*b* opposed to the main plate 102.

Attachment of the circuit unit to the main plate 102 can be carried out by, for example, providing four of coil guide holes (not illustrated) in a circular shape at the main plate 102 and arranging the circuit unit to the main plate 102 such that the coils 180 are contained in the respective coil guide holes.

Figure 37:
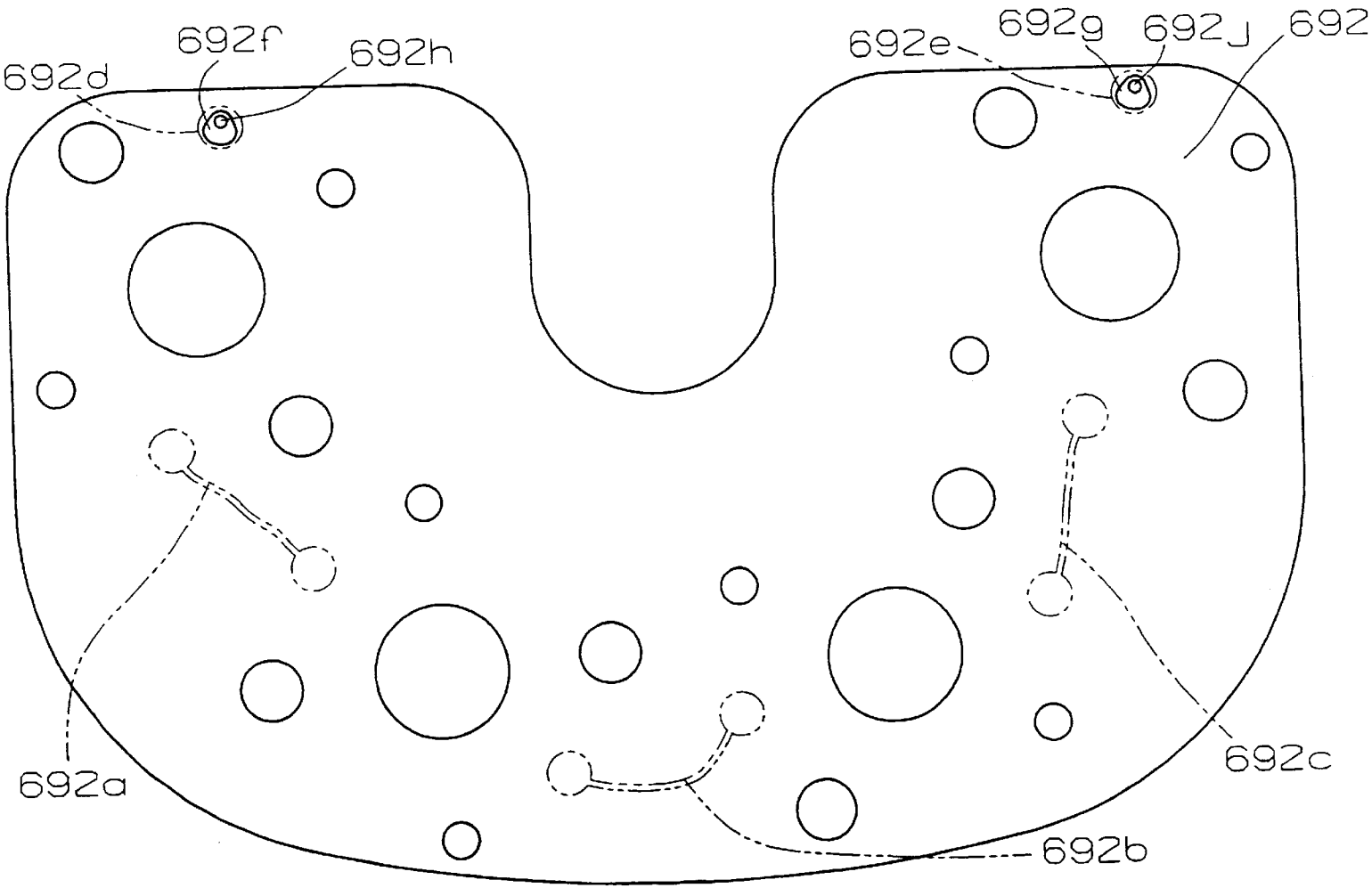
FIG. 37 is a front plane view showing an outline shape of a circuit board used in a modified example of Embodiment 1 of a mechanical time piece according to the invention.

According to such a constitution, by three of coil conducting patterns 692*a*, 692*b* and 692*c* provided at a circuit board 692 (refer to FIG. 37), four of the coils 180 are conducted in series.

Figure 26:
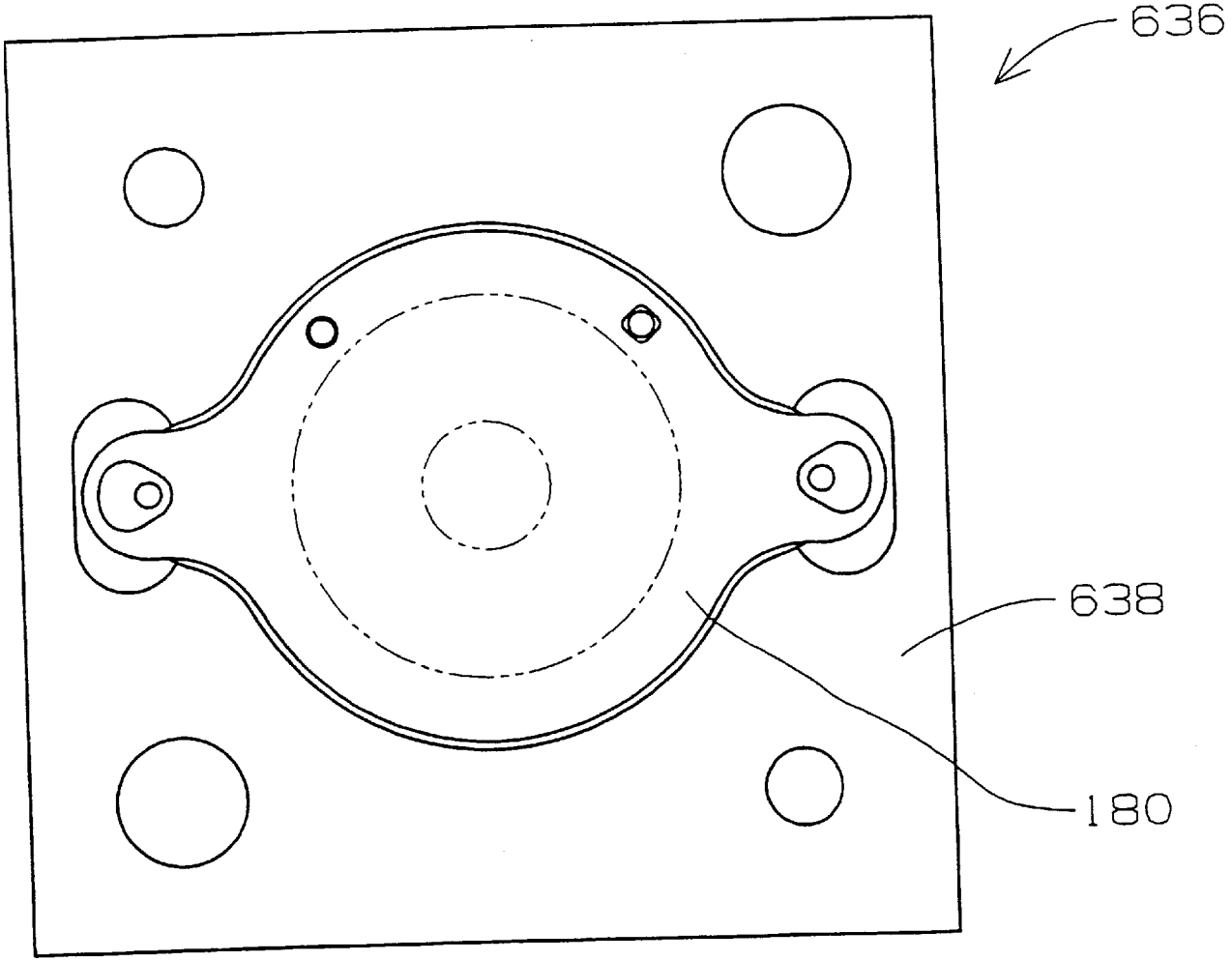
FIG. 26 is a front plane view showing an outline shape of other modified mode of a coil unit according to Embodiment 1 of a mechanical time piece of the invention.
Figure 27:
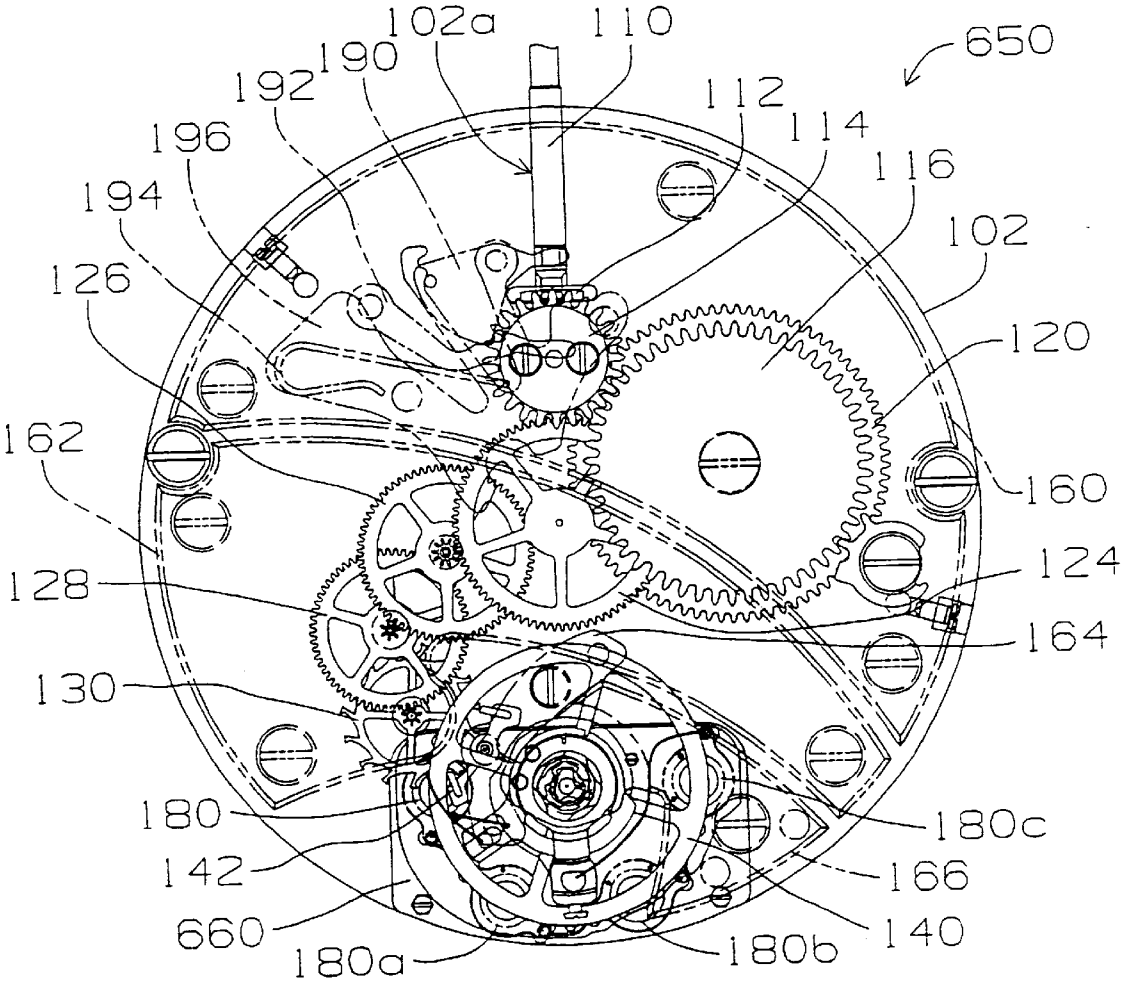
FIG. 27 is a plane view showing an outline shape of a front side of a movement according to Embodiment 2 of a mechanical time piece of the invention (in FIG. 27, portions of parts are omitted and bridge members are indicated by imaginary lines).
Figure 28:
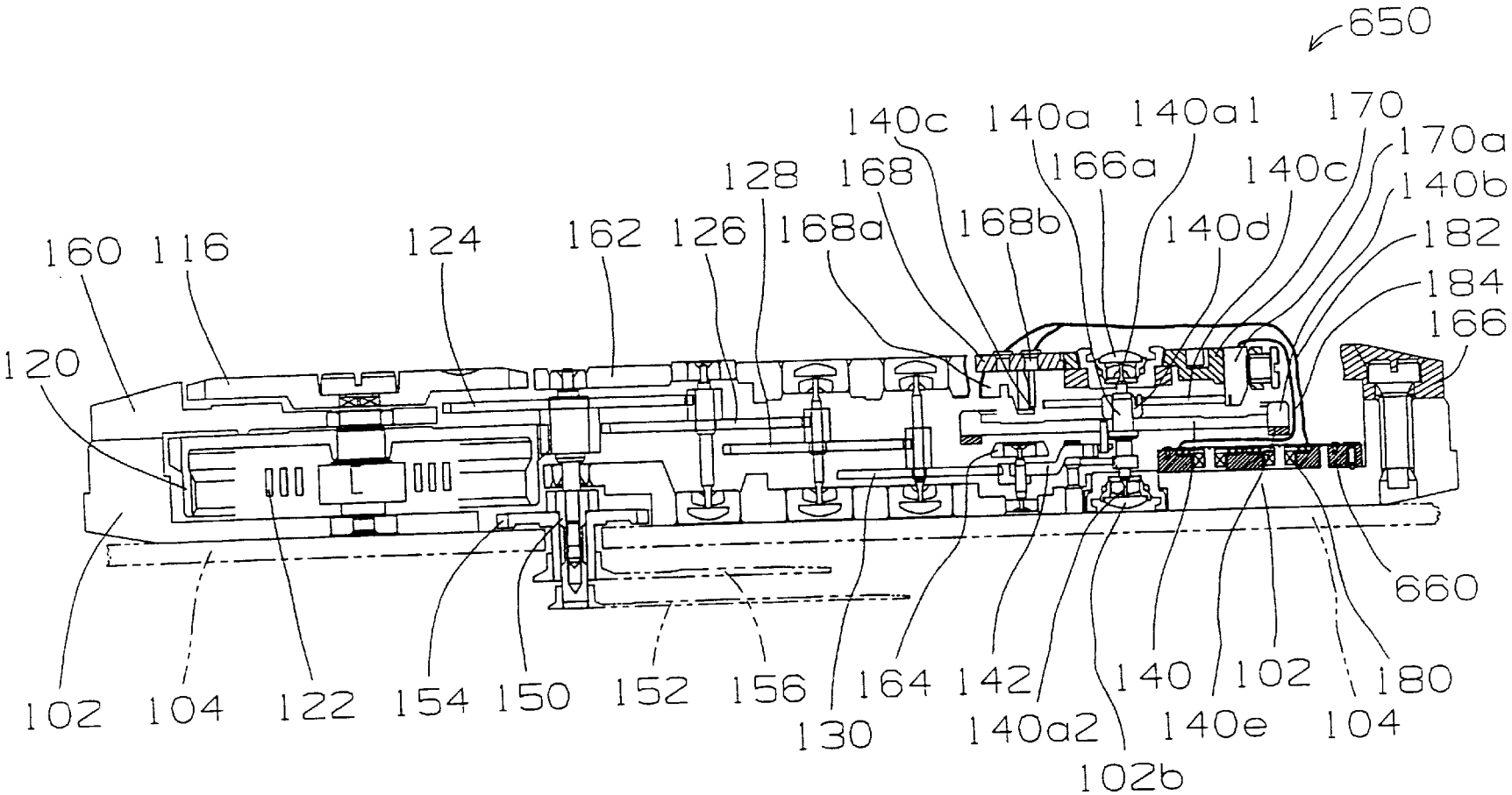
FIG. 28 is an outline partial sectional view of the movement according to Embodiment 2 of the mechanical time piece of the invention (in FIG. 28, portions of parts are omitted).

As other modified example, in reference to FIG. 26, a coil unit 636 includes a coil bridge 638 and the coil 180. The outer peripheral shape of the coil bridge 638 is square. The circuit board 692 is fixed to faces of the respective coil bridges 638 of four of the coil units 636 opposed to the balance wheel 140*b* by the circuit board fixing screws 618. The circuit unit is attached to the face of the front side of the main plate 102 by the circuit unit fixing screws 620. That is, four of the coil units 636 are attached to the face of the front side of the main plate 102 in a state in which four of the coils 180 are respectively arranged on the side of the main plate 102 of the circuit board 692 such that the circuit board 692 is opposed to the face of the balance wheel 140*b* opposed to the main plate 102.

Attachment of the circuit unit to the main plate 102 can be realized by, for example, providing four of coil guide holes (not illustrated) in a square shape at the main plate 102 and arranging the circuit unit to the main plate 102 such that the coils 180 are contained respectively in the coil guide holes.

Also according to the constitution, by three of the coil conducting patterns 692*a*, 692*b* and 692*c* provided at the circuit board 692, four of the coils 180 are conducted in series.

According to the constitutions of the two modified examples shown here, four of the same coils 180 are used and accordingly, when one of the coils 180 is destructed, only the coil can be interchanged.

A balance magnet 140*e* is attached to a side face of the balance wheel 140*b* on the main plate side to be opposed to the face of the main plate 102 on the front side.

Figure 3:
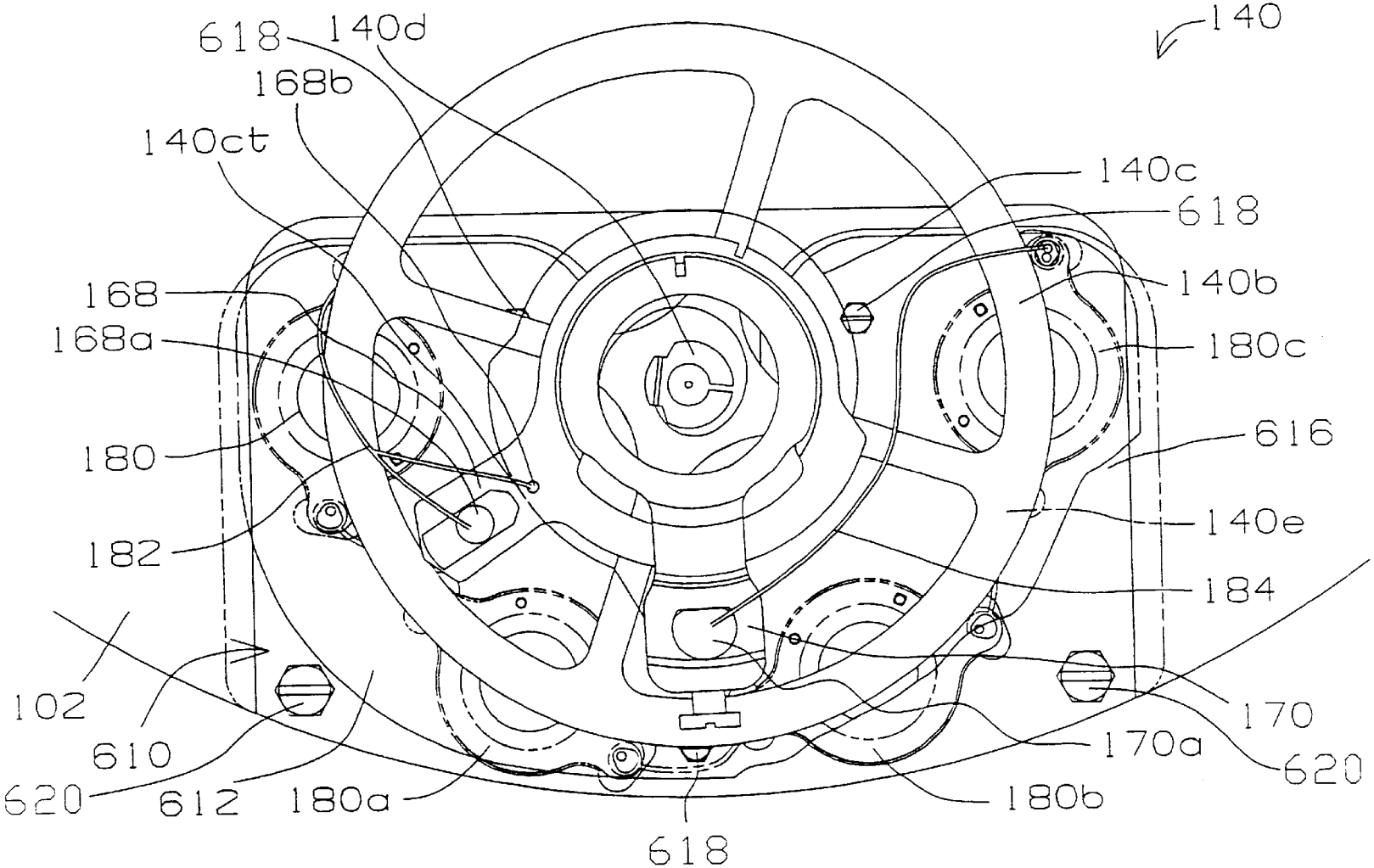
FIG. 3 is a plane view of an enlarged portion showing an outline shape of a portion of a balance with hairspring in a state in which a switch mechanism is made OFF according to Embodiment 1 of the mechanical time piece of the invention (in FIG. 3, a portion of a circuit board is shown to be broken to indicate portions of shapes of coils).
Figure 4:
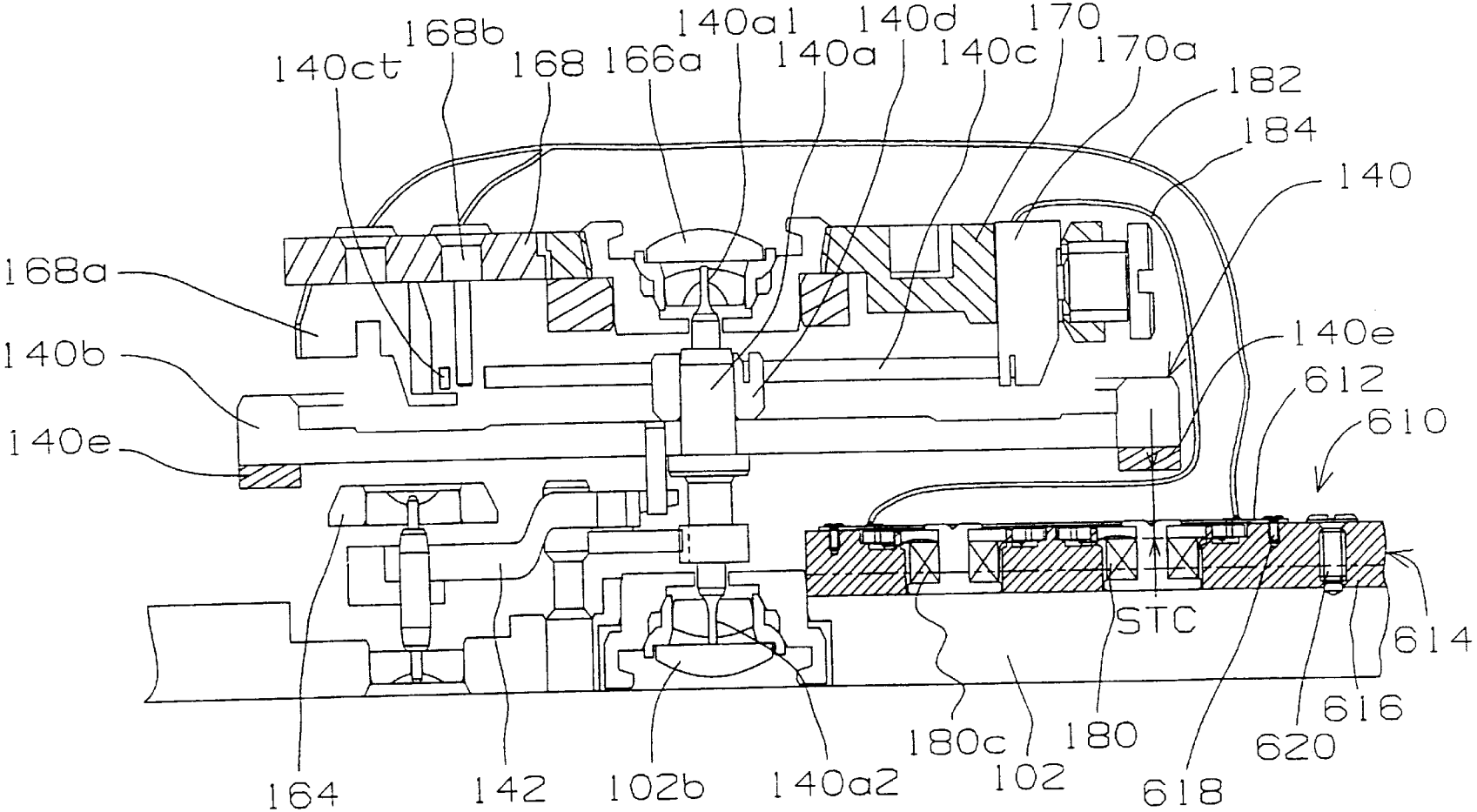
FIG. 4 is a sectional view of the enlarged portion showing the outline shape of the portion of the balance with hairspring in the state in which the switch mechanism is made OFF according to Embodiment 1 of the mechanical time piece of the invention.
Figure 5:
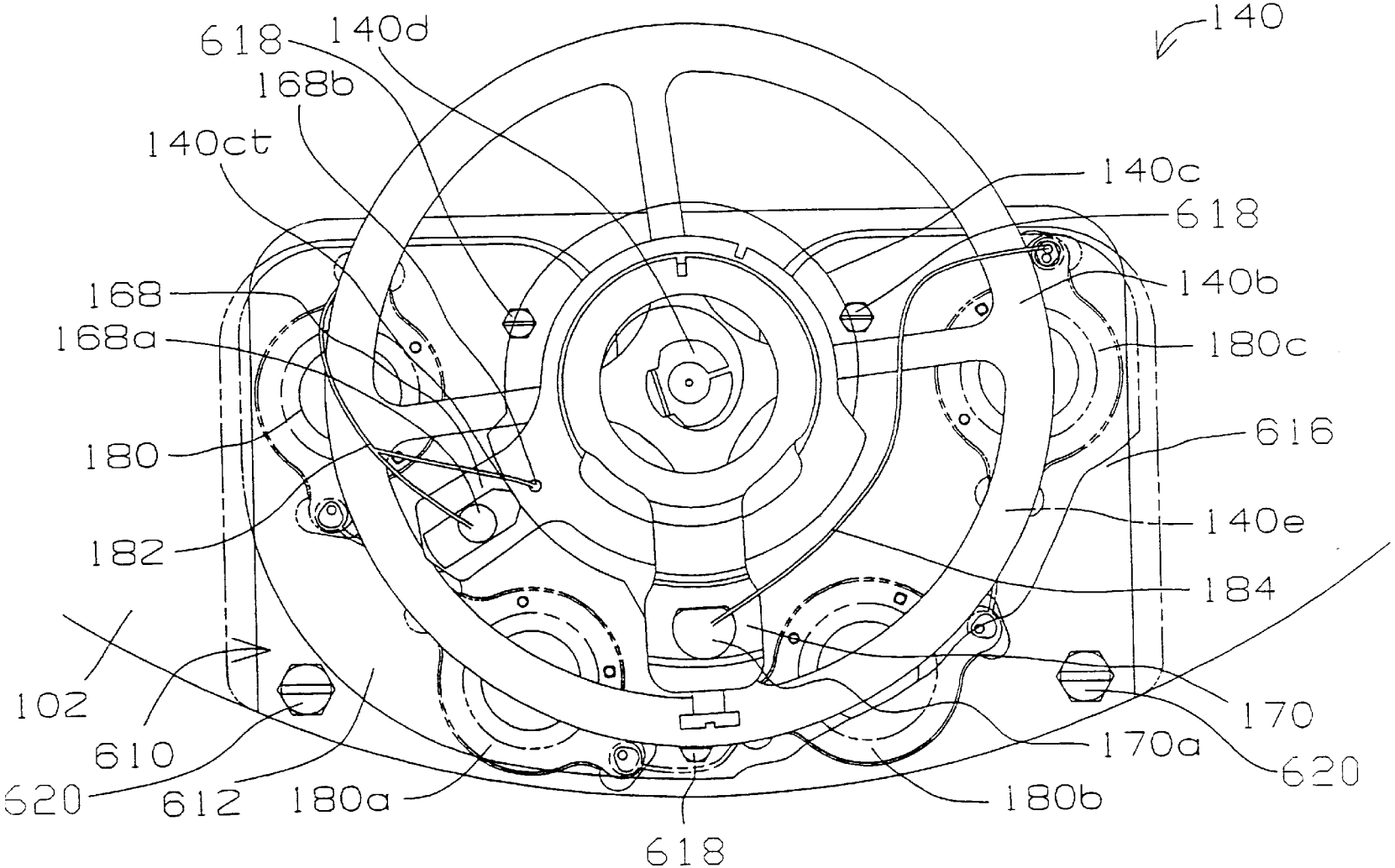
FIG. 5 is a plane view of the enlarged portion showing the outline shape of the portion of the balance with hairspring in the state in which the switch mechanism is made ON according to Embodiment 1 of the mechanical time piece of the invention (in FIG. 5, a portion of the circuit board is shown to be broken to indicate portions of shapes of coils).

Although it is preferable that as shown by FIG. 1, FIG. 3 and FIG. 5, an interval in a circumferential direction of the coil in the case of arranging the plurality of pieces of coils, is an interval in the circumferential direction of an S pole and an N pole of the balance magnet 140*e* arranged to be opposed to the coil multiplied by an integer, the interval may not be the same for all of the coils in the circumferential direction. Further, according to such structure of providing the plurality of pieces of coils, wirings among the respective coils may be wired in series such that currents generated at the respective coils by electromagnetic induction are not canceled by each other (refer to FIG. 1 through FIG. 4).

Alternatively, as a modified example, the wirings among the respective coils may be wired in parallel such that currents generated at the respective coils by electromagnetic induction are not canceled by each other (illustration is omitted for such constitution).

Figure 7:
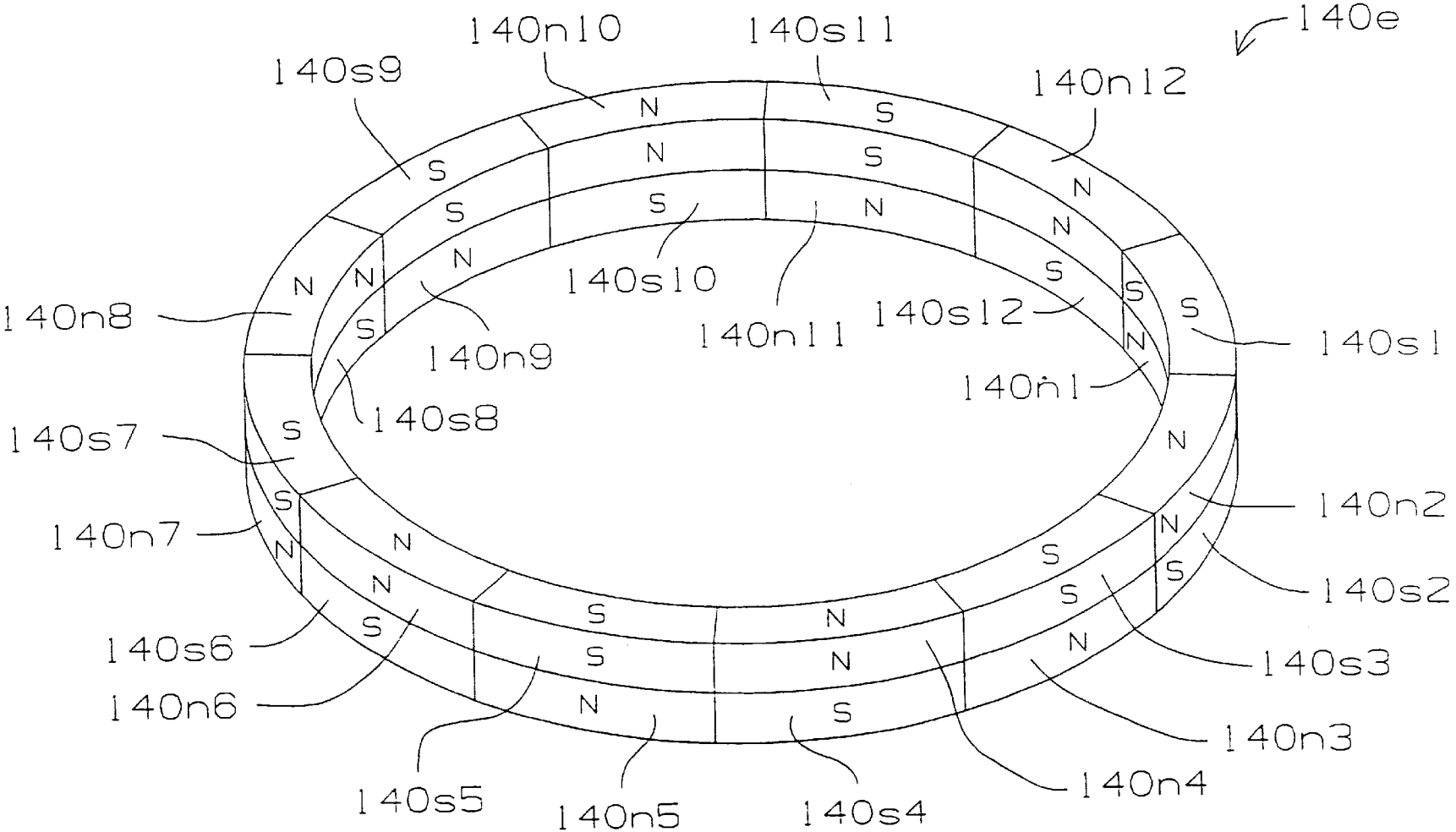
FIG. 7 is a perspective view showing an outline shape of a balance magnet used in a mechanical time piece of the invention.
Figure 8:
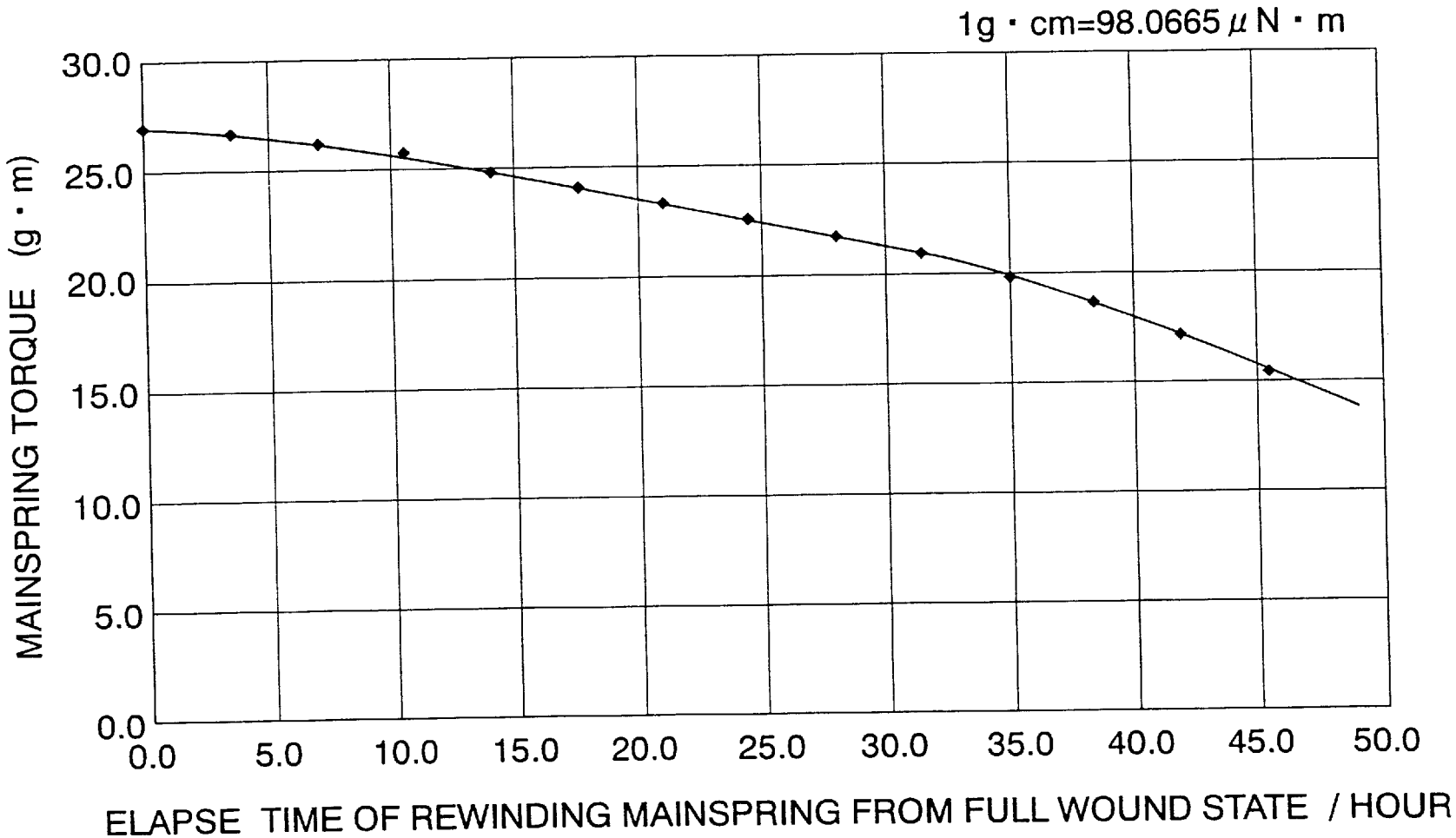
FIG. 8 is a graph showing an outline relationship between an elapse time period of rewinding a mainspring from a fully wound state and mainspring torque in a mechanical time piece.
Figure 9:
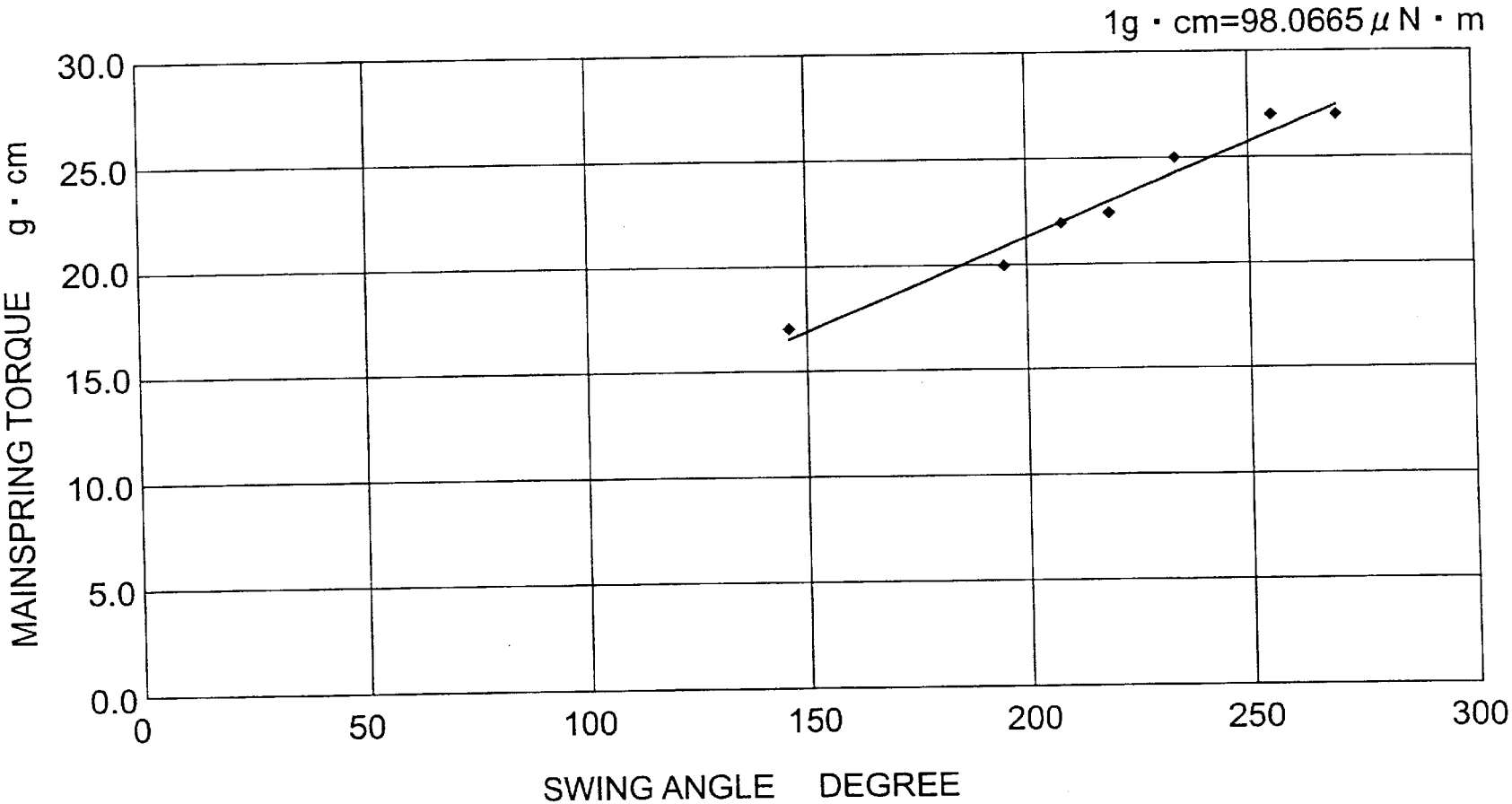
FIG. 9 is a graph showing an outline relationship between swing angle of a balance with hairspring and mainspring torque in a mechanical time piece.
Figure 10:
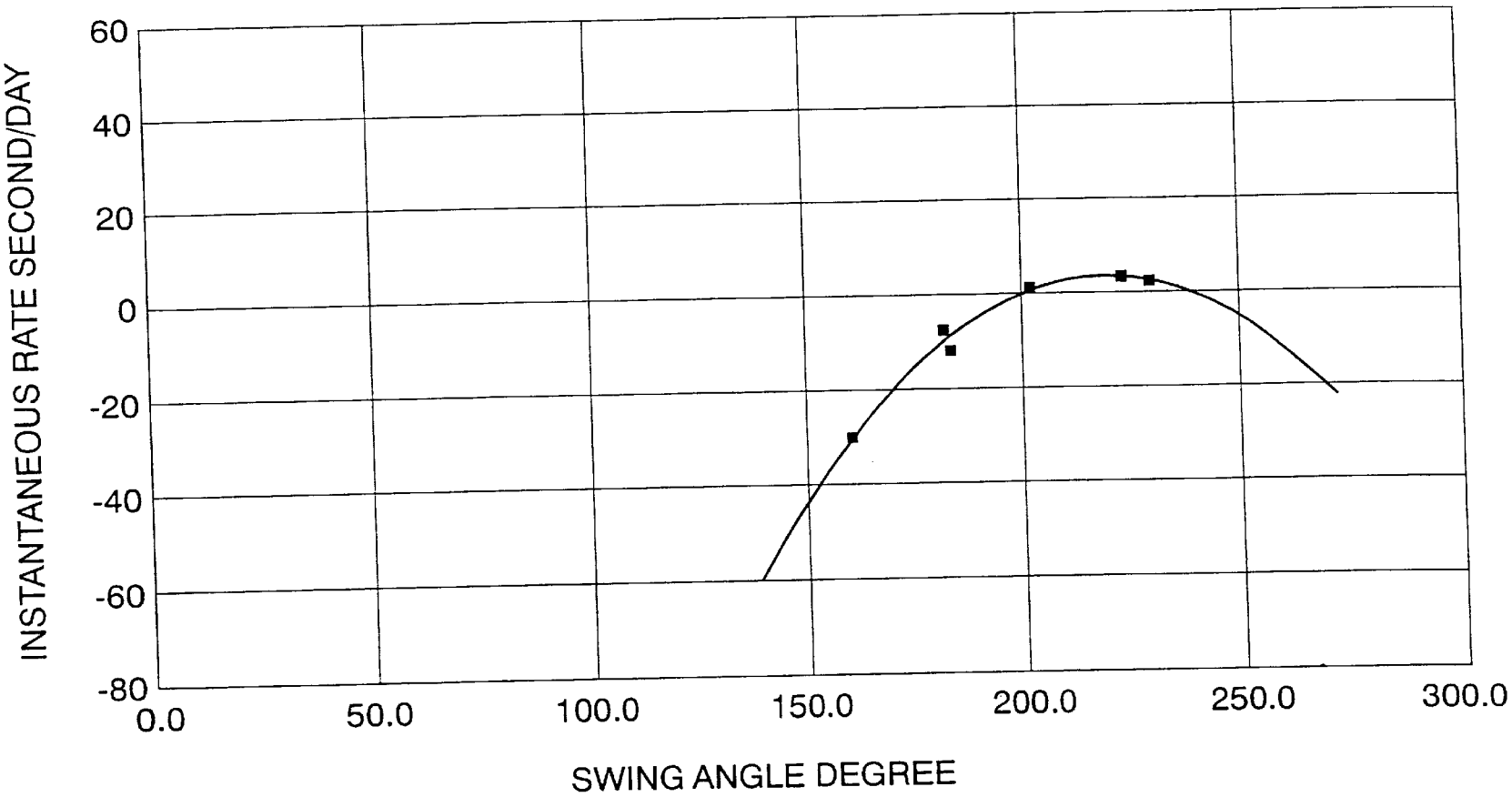
FIG. 10 is a graph showing an outline relationship between swing angle of a balance with hairspring and instantaneous rate in a mechanical time piece.

In reference to FIG. 7, the balance magnet 140*e* is provided with a mode in an annular shape (ring-like shape) and along its circumferential direction, for example, there are alternately provided magnet portions comprising 12 pieces of S poles 140*s*1 through 140*s*12 and 12 pieces of N poles 140*n*1 through 140*n*12 which are polarized in the up and down direction. Although a number of the magnet portions arranged in the annular shape (ring-like shape) in the balance magnet 140*e* is 12 in the example shown in FIG. 7, the number may be a plural number of 2 or more. In this case, it is preferable that a length of one chord of the magnet portion is substantially equal to an outer diameter of one coil provided to be opposed to the magnet portion.

A gap is provided between the balance magnet 140*e* and the coils 180, 180*a*, 180*b* and 180*c*. The gap between the balance magnet 140*e* and the coils 180, 180*a*, 180*b* and 180*c*, is determined such that magnetic force of the balance magnet 140*e* can effect influence on the coils 180, 180*a*, 180*b* and 180*c* when the coils 180, 180*a*, 180*b* and 180*c* are conducted.

When the coils 180, 180*a*, 180*b* and 180*c* are not conducted, the magnetic force of the balance magnet 140*e* does not effect influence on the coils 180, 180*a*, 180*b* and 180*c*. The balance magnet 140*e* is fixed to a face of the balance ring 140*b* on the side of the main plate by adhering or the like in a state in which one face of the balance magnet 140*e* is brought into contact with a ring-like rim portion of the balance wheel 140*b* and other face thereof is opposed to the face of the main plate 102 on the front side.

A first lead wire 182 is provided to conduct one terminal of the coil 180 and the first terminal member 168*a* and the second terminal member 168*b*. The first lead wire 182 is connected to a first lead connecting pattern of the circuit board 612 conducted to the one terminal of the coil 180.

A second lead wire 184 is provided to conduct one terminal of the coil 180*c* and the hairspring holder 170. The second lead wire 184 is connected to a second lead connecting pattern of the circuit board 612 conducted to the one terminal of the coil 180c.

Further, although in FIG. 4, the thickness of the hairspring 140*c* (thickness in radius direction of balance with hairspring) is illustrated to exaggerate, the thickness is, for example, 0.021 millimeter. According to the balance magnet 140*e*, for example, an outer diameter thereof is about 9 millimeters, an inner diameter thereof ia bout 7 millimeters, a thickness thereof is about 1 millimeter and a magnetic flux density thereof is about 0.02 tesla. A turn number of each of the coils 180, 180*a*, 180*b* and 180*c* is, for example, 8 turns and the coil wire diameter is about 25 micrometers. The gap STC between the balance magnet 140*e* and the coils 180, 180*a*, 180*b* and 180*c* is, for example, about 0.4 millimeter.

(1.3) Operation of Balance with Hairspring when Circuit is opened.

An explanation will be given of operation of the balance with hairspring 140 when the coils 180, 180*a*, 180*b* and 180*c* are not conducted, that is, when a circuit is opened in reference to FIG. 3, FIG. 4 and FIG. 11.

The hairspring 140*c* is expanded and contracted in the radius direction of the hairspring 140*c* in accordance with rotational angle of rotating the balance with hairspring 140. For example, in a state shown by FIG. 3, when the balance with hairspring 140 is rotated in the clockwise direction, the hairspring 140*c* is contracted in a direction toward the center of the balance with hairspring 140, in contrast thereto, when the balance with hairspring 140 is rotated in the counterclockwise direction, the hairspring 140*c* is expanded in a direction remote from the center of the balance with hairspring 140.

Therefore, in reference to FIG. 4, when the balance with hairspring 140 is rotated in the clockwise direction, the hairspring 140*c* is operated to approach the second terminal member 168*b*. In contrast thereto, when the balance with hairspring 140 is rotated in the counterclockwise direction, the hairspring 140*c* is operated to approach the first terminal member 168*a*.

When the rotational angle (swing angle) of the balance with hairspring 140 is less than a constant threshold, for example, 180 degree, an amount of expanding and contracting the hairspring 140*c* in the radius direction is small and therefore, the hairspring 140*c* is not brought into contact with the first terminal member 168*a* and is not brought into contact also with the second terminal member 168*b*.

When the rotational angle (swing angle) of the balance with hairspring 140 is equal to or larger than the constant threshold, for example, 180 degree, the amount of expanding and contracting the hairspring 140*c* in the radius direction becomes sufficiently large and accordingly, the hairspring 140*c* is brought into contact with both of the first terminal member 168*a* and the second terminal member 168*b*.

For example, a portion 140*ct* of the hairspring 140*c* proximate to an outer end portion of the hairspring 140*c* is disposed in a clearance of about 0.04 millimeter between the first terminal member 168*a* and the second terminal member 168*b*. Therefore, in a state in which the swing angle of the balance with hairspring 140 falls in a range of exceeding 0 degree and less than 180 degree, the portion 140*ct* proximate to the outer end portion of the hairspring 140*c* is not brought into contact with the first terminal member 168*a* and is not brought into contact also with the second terminal member 168*b*. That is, the outer end portion of the hairspring 140*c* is not brought into contact with the first terminal member 168*a* and is not brought into contact also with the second terminal member 168*b* and accordingly, the coils 180, 180*a*, 180*b* and 180*c* are not conducted and magnetic flux of the balance magnet 140*e* does not effect influence on the coils 180, 180*a*, 180*b* and 180*c*. As a result, the swing angle of the balance with hairspring 140 is not attenuated by operation of the balance magnet 140*e* and the coils 180, 180*a*, 180*b* and 180*c*.

(1.4) Operation of Balance with Hairspring when Circuit is Closed

Next, an explanation will be given of operation of the balance with hairspring 140 when the coils 180, 180*a*, 180*b* and 180*c* are conducted, that is, when the circuit is closed in reference to FIG. 5, FIG. 6 and FIG. 11. That is, FIG. 5 and FIG. 6 show a case in which the swing angle of the balance with hairspring 140 is equal to or larger than 180 degree.

Figure 6:
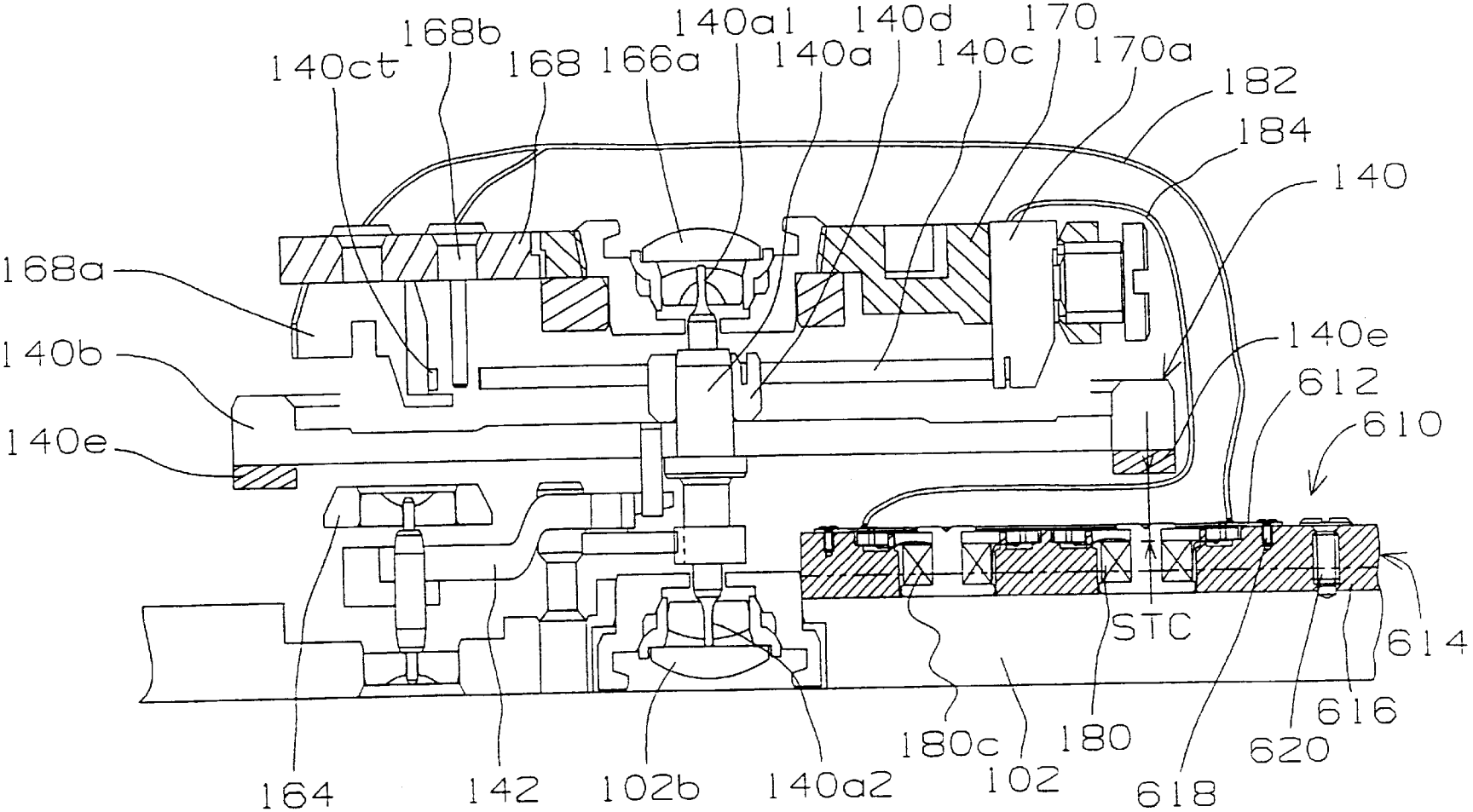
FIG. 6 is a sectional view of the enlarged portion showing the outline shape of the portion of the balance with hairspring in a state in which the switch mechanism is made ON according to Embodiment 1 of the mechanical time piece of the invention.

Further, in FIG. 6, the thickness of the hairspring 140*c* (thickness in radius direction of balance with hairspring) is illustrated to exaggerate.

When the swing angle of the balance with hairspring 140 becomes equal to or larger than 180 degree, the portion 140*ct* proximate to the outer end portion of the hairspring 140*c* is brought into contact with the first terminal member 168*a* or the second terminal member 168*b*. Under the state, the coils 180, 180*a*, 180*b* and 180*c* are conducted and a force for restraining rotational motion of the balance with hairspring 140 is exerted to the balance with hairspring 140 by induction current generated by a change in the magnetic flux of the balance magnet 140*e*. Further, by the operation, braking force for restraining rotation of the balance with hairspring 140 is exerted to the balance with hairspring 140 to thereby reduce the swing angle of the balance with hairspring 140.

Further, when the swing angle of the balance with hairspring 140 is reduced to the range of exceeding 0 degree and less than 180 degree, there is brought about a state in which the portion 140*ct* proximate to the outer end portion of the hairspring 140*c* is not brought into contact with the first terminal member 168*a* and is not brought into contact with the second terminal member 168*b*. Therefore, as shown by FIG. 3 and FIG. 4, the outer end portion of the hairspring 140*c* is not brought into contact with the first terminal member 168*a* and is not brought into contact with the second terminal member 168*b* and accordingly, the coils 180, 180*a*, 180*b* and 180*c* are not conducted and the magnetic flux of the balance magnet 140*e* does not effect influence on the coils 180, 180*a*, 180*b* and 180*c*.

(1.5) Effect of Balance Rotational Angle Control Mechanism

According to the mechanical time piece of the invention constituted in this way, the rotational angle of the balance with hairspring 140 can efficiently be controlled.

According to the invention, as explained above, there is constructed the constitution in which the balance rotational angle control mechanism is provided in the mechanical time piece constituted such that the escapement & speed control apparatus includes the balance with hairspring repeating right rotation and left rotation, the escape wheel & pinion rotated based on rotation of the front train wheel and the pallet fork for controlling rotation of the escape wheel & pinion based on operation of the balance with hairspring and accordingly, accuracy of the mechanical time piece can be promoted without reducing a duration time period of the mechanical time piece.

That is, according to the invention, attention is paid to the correlation between the instantaneous rate and the swing angle by maintaining constant the swing angle, the change in the instantaneous rate is restrained and gain or loss of the time piece per day is adjusted to reduce.

In contrast thereto, according to the conventional mechanical time piece, by the relationship between the duration time period and the swing angle, the swing angle is changed with elapse of time. Further, by the relationship between the swing angle and the instantaneous rate, the instantaneous rate is changed with elapse of time. Therefore, it has been difficult to prolong the duration time period of the time piece capable of maintaining constant accuracy.

(2) Embodiment 2 of Mechanical Time Piece of the Invention (2.1) Constitution of Embodiment 2 of Mechanical Time Piece of the Invention Next, an explanation will be given of Embodiment 2 of a mechanical time piece according to the invention. In the following explanation, an explanation will be given mainly of a portion of Embodiment 2 of the mechanical time piece of the invention which is different from Embodiment 1 of the mechanical time piece of the invention. Therefore, content described below can be understood by referring to the explanation of Embodiment 1 of the mechanical time piece according to the invention.

With reference to FIG. 27 through FIG. 30, a circuit unit 660 is attached to the face of the front side of the main plate 102. The circuit unit 660 includes the circuit board 612 and a coil unit 664. The coil unit 664 includes a coil bridge 666 and four of the coils 180, 180*a*, 180*b* and 180*c*. The coil unit 614 is attached to the face of the front side of the main plate 102 such that the coils 180, 180*a*, 180*b* and 180*c* are opposed to the face of the balance wheel 140*b* on the side of the main plate.

The circuit board 612 is fixed to the face of the coil bridge 666 opposed to the balance wheel 140*b* by the circuit board fixing screws 618. The circuit unit 660 is attached to the face of the front side of the main plate 102 by the circuit unit fixing screws 620. That is, as shown by FIG. 1 through FIG. 4, the coil unit 664 is attached to the face of the main plate 102 on the front side in the state in which four of the coils 180, 180*a*, 180*b* and 180*c* are respectively arranged to the circuit board 612 on the side of the main plate 102 such that the circuit board 612 is opposed to the face of the balance wheel 140*b* opposed to the main plate 102.

The circuit board 612 is provided with three of coil conducting patterns (not illustrated) provided to conduct the coil 180, 180*a*, 180*b* and 180*c* in series.

When the circuit unit 660 is attached to the main plate 102, attachment may be carried out such that the circuit unit 660 is arranged to the surface of the main plate 102 such that a guiding circular arc portion 666*w* (refer to FIG. 30) of the coil bridge 666 matches the outer peripheral portion of the balance lower bearing 102*b* fixed to the main plate 102. According to the constitution, the circuit unit 660 is attached to the main plate 102 before attaching the balance with hairspring 140 to the movement.

(2.2) Operation of Balance with Hairspring when Circuit Is Opened

Figure 11:
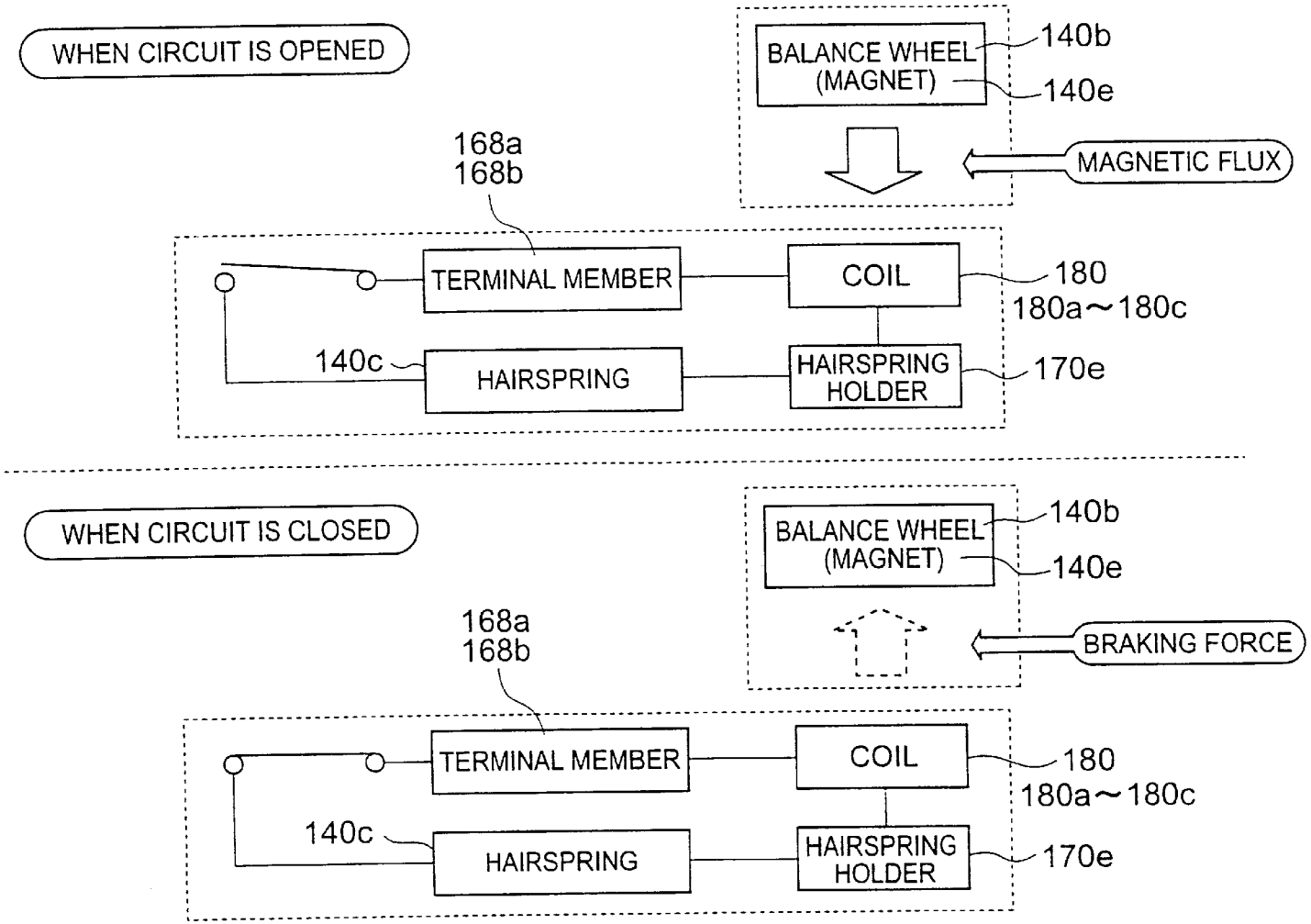
FIG. 11 is a block diagram showing operation when a circuit is opened and operation when the circuit is closed in a mechanical time piece of the invention.
Figure 29:
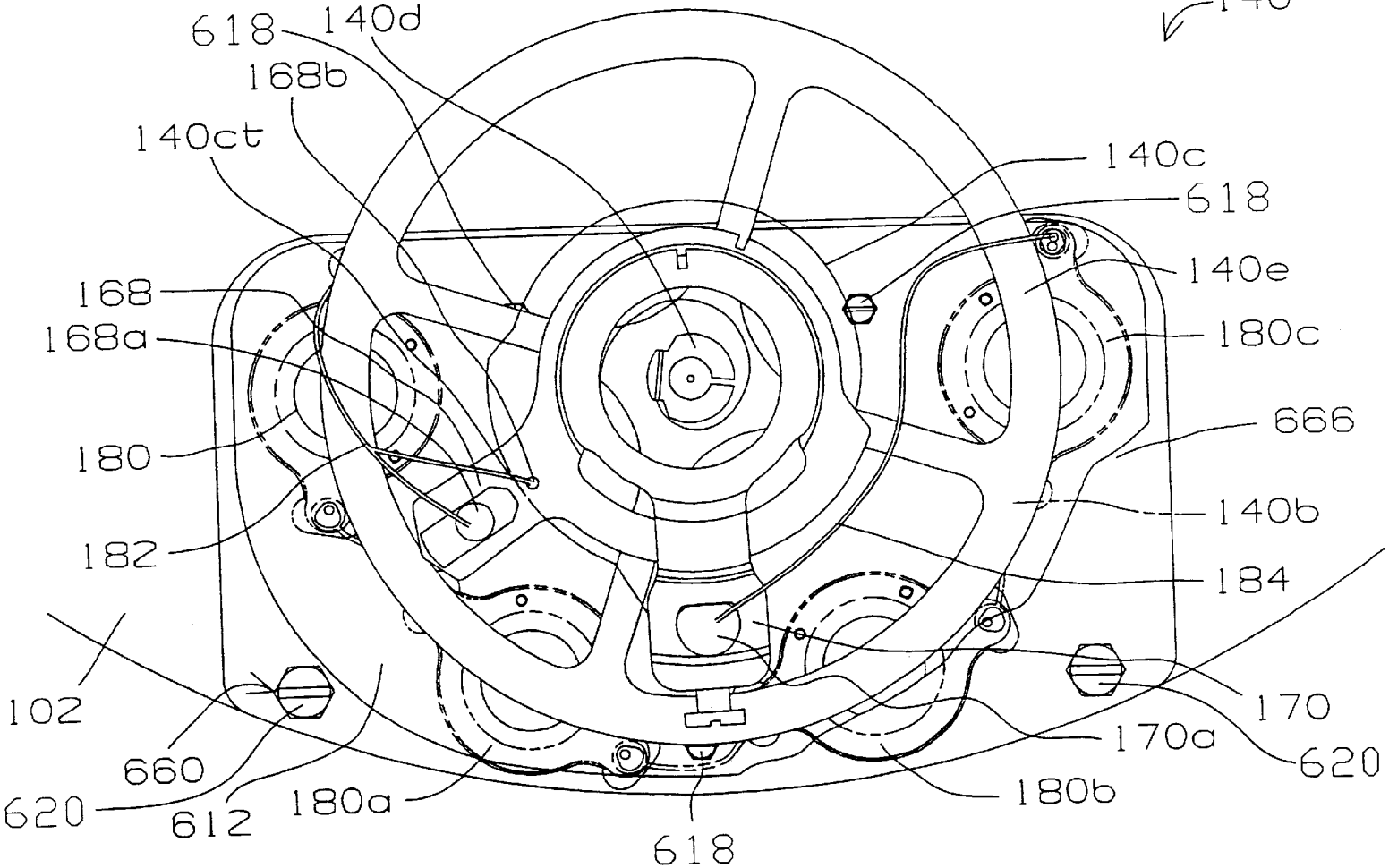
FIG. 29 is a plane view of an enlarged portion showing an outline shape of a portion of a balance with hairspring in a state in which a switch mechanism is made OFF according to Embodiment 2 of the mechanical time piece of the invention (in FIG. 29, a portion of a circuit board is shown to be broken to indicate portions of shapes of coils).
Figure 30:
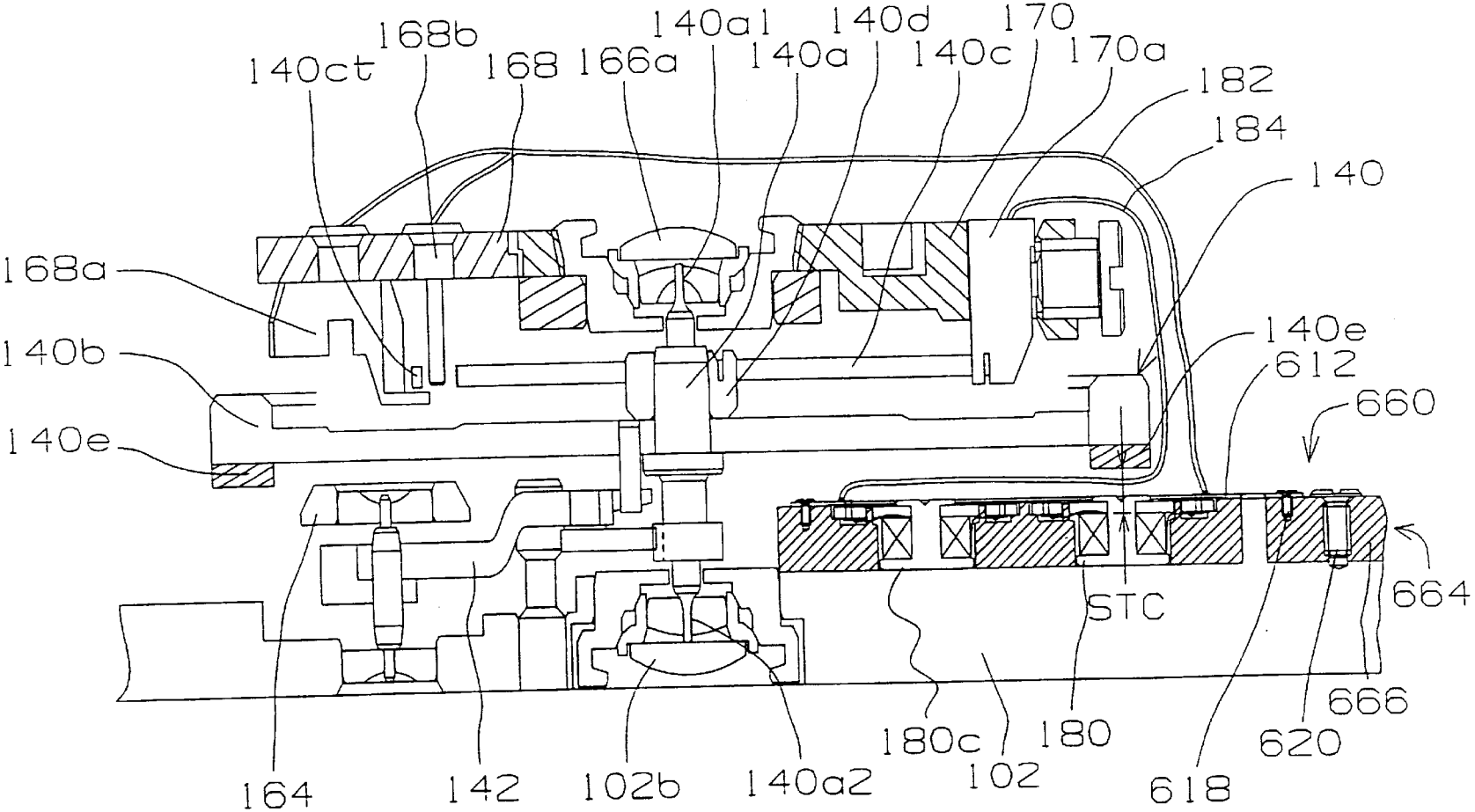
FIG. 30 is a sectional view of an enlarged portion showing an outline shape of a portion of a balance with hairspring in the state in which the switch mechanism is made OFF according to Embodiment 2 of the mechanical time piece of the invention.

As shown by FIG. 29 and FIG. 30, operation of the balance with hairspring when the circuit is opened, according to Embodiment 2 of the mechanical time piece of the invention, is similar to the above-described content explained in reference to FIG. 3, FIG. 4 and FIG. 11. Therefore, a detailed explanation thereof will be omitted.

(2.3) Operation of Balance with Hairspring when Circuit Is Closed

Figure 31:
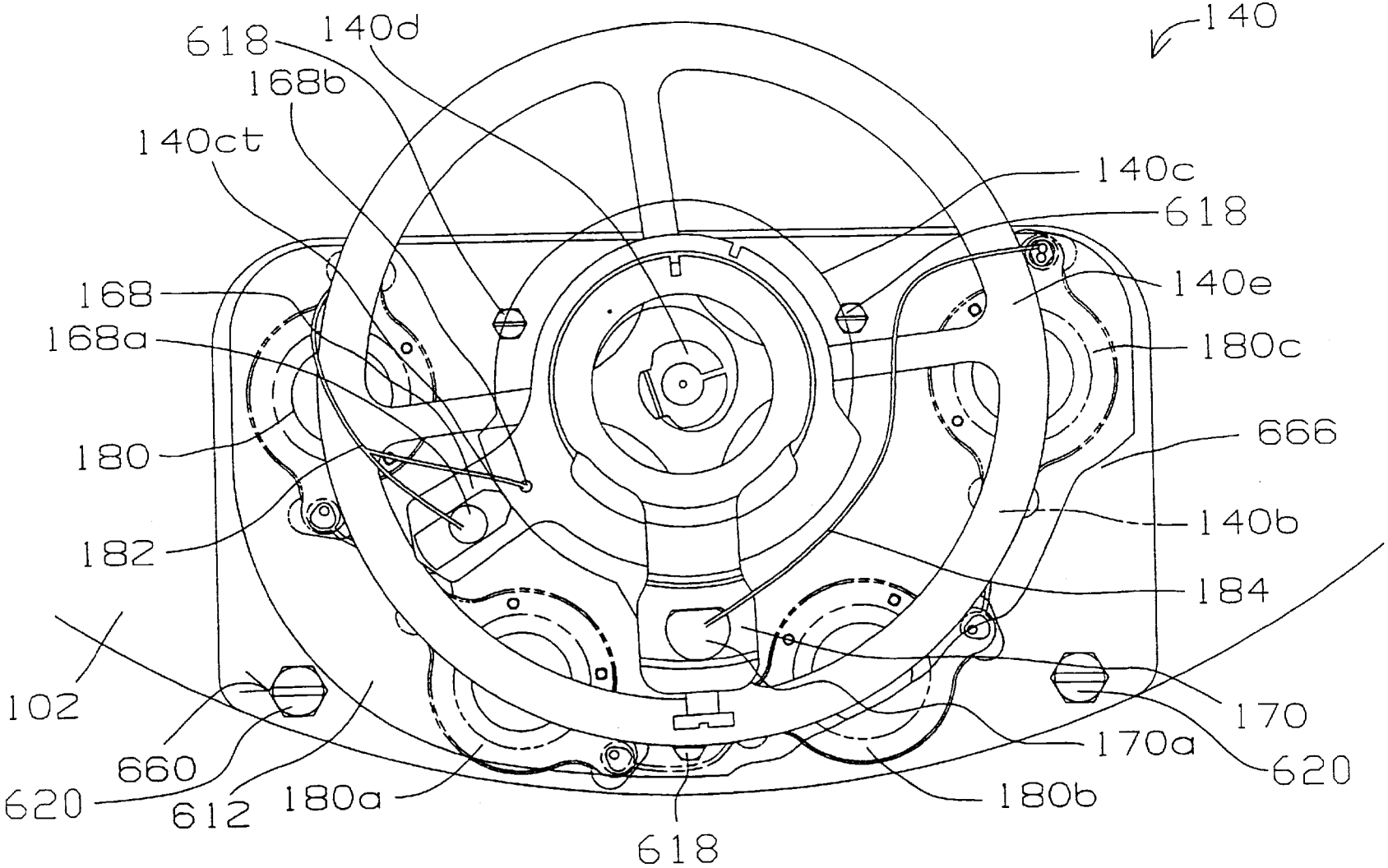
FIG. 31 is a plane view of the enlarged portion showing the outline shape of the portion of the balance with hairspring in a state in which the switch mechanism is made ON according to Embodiment 2 of the mechanical time piece of the invention (in FIG. 31, a portion of the circuit board is shown to be broken to indicate portions of shapes of coils).
Figure 32:
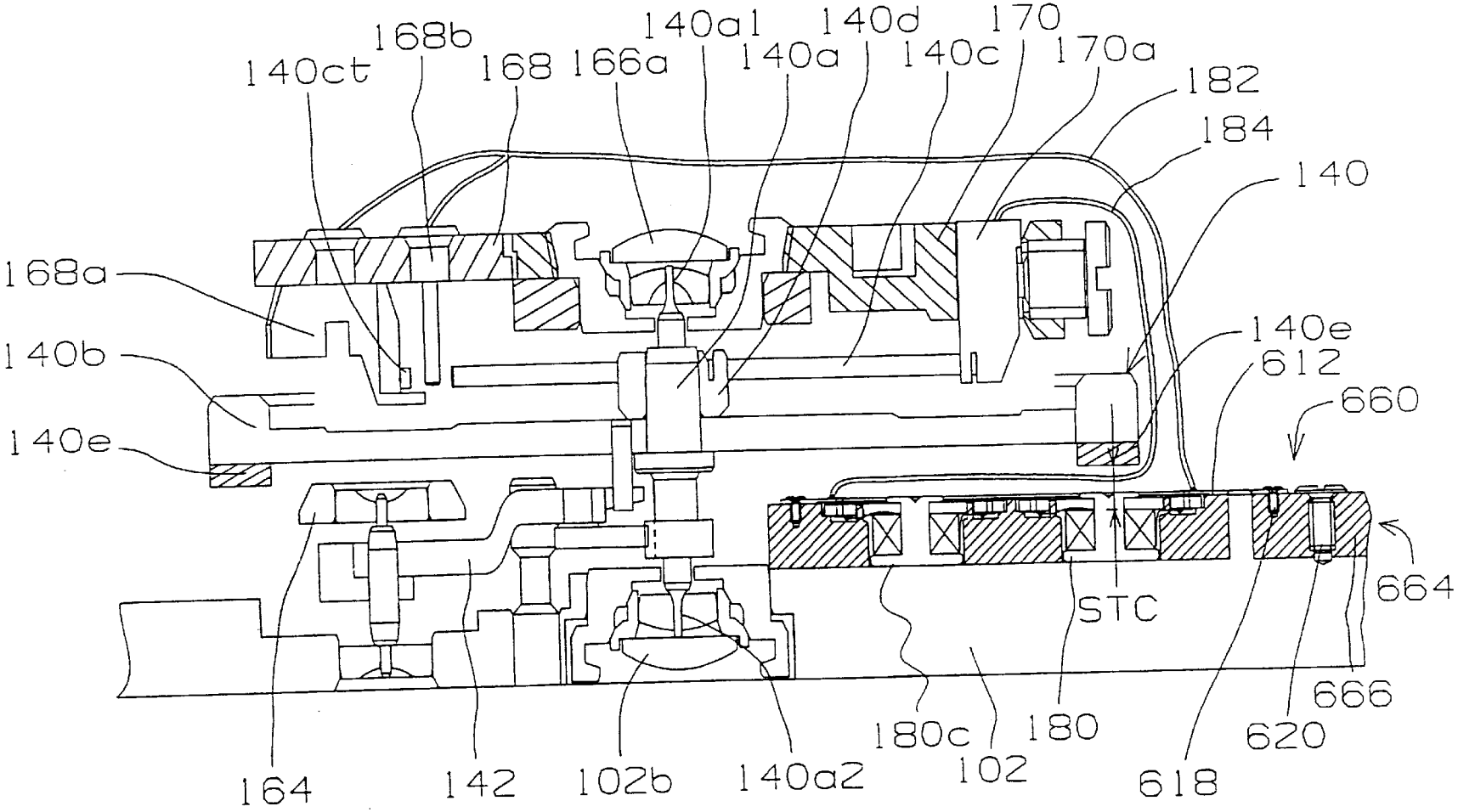
FIG. 32 is a sectional view of the enlarged portion showing the outline shape of the portion of the balance with hairspring in the state in which the switch mechanism is made ON according to Embodiment 2 of the mechanical time piece of the invention.

As shown by FIG. 31 and FIG. 32, operation of the balance with hairspring when the circuit is closed, according to Embodiment 2 of the mechanical time piece of the invention, is similar to the above-described content explained in reference to FIG. 5, FIG. 6 and FIG. 11. Therefore, a detailed explanation thereof will be omitted.

(3) Result of Simulation with Respect to Instantaneous Rate

Next, an explanation will be given of a result of a simulation with regard to the instantaneous rate which is carried out with regard to the mechanical time piece of the invention developed in order to resolve the problem of the conventional mechanical time piece.

Figure 12:
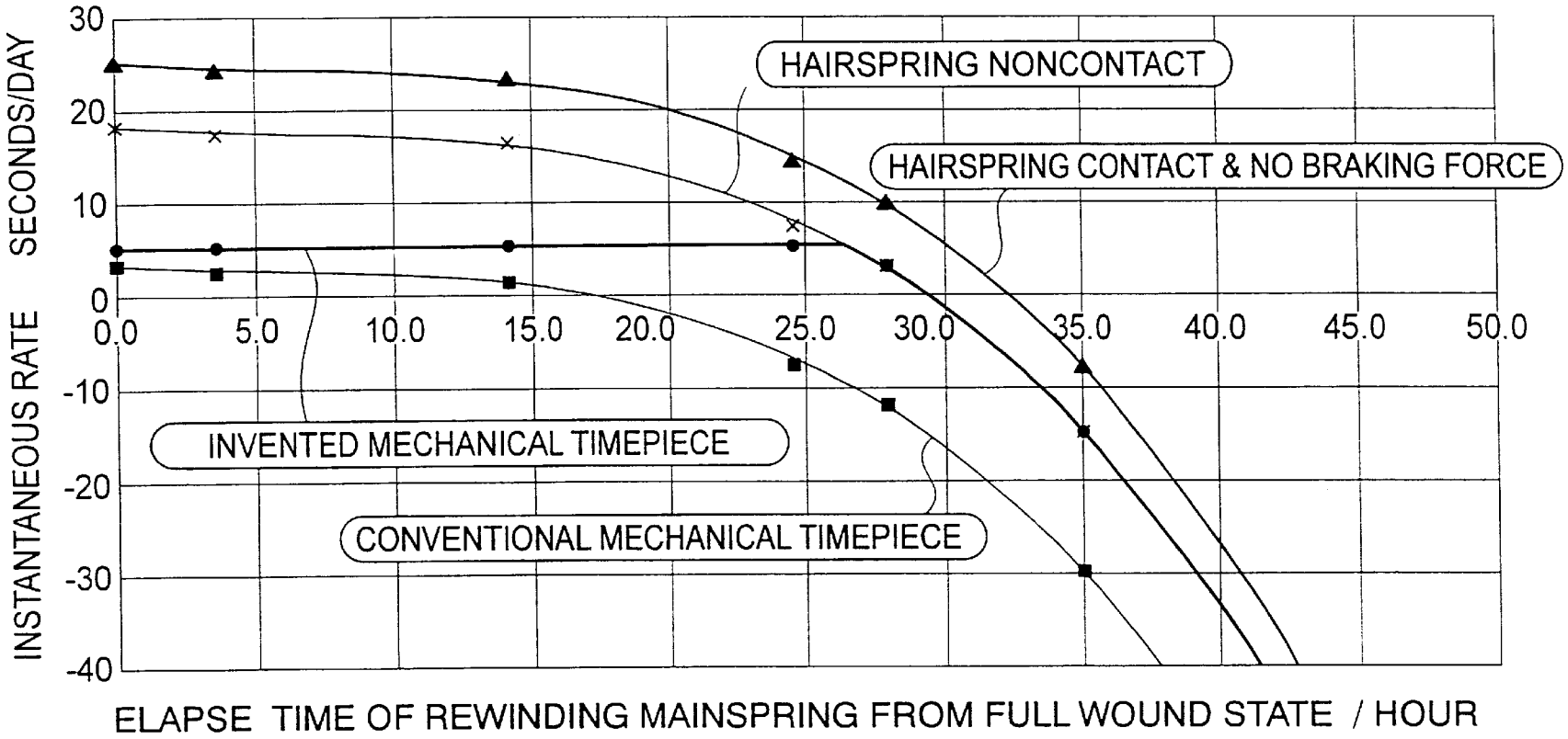
FIG. 12 is a graph showing an outline relationship between an elapse time period of rewinding a mainspring from a fully wound state and instantaneous rate according to a mechanical time piece of the invention and a conventional mechanical time piece.
Figure 13:
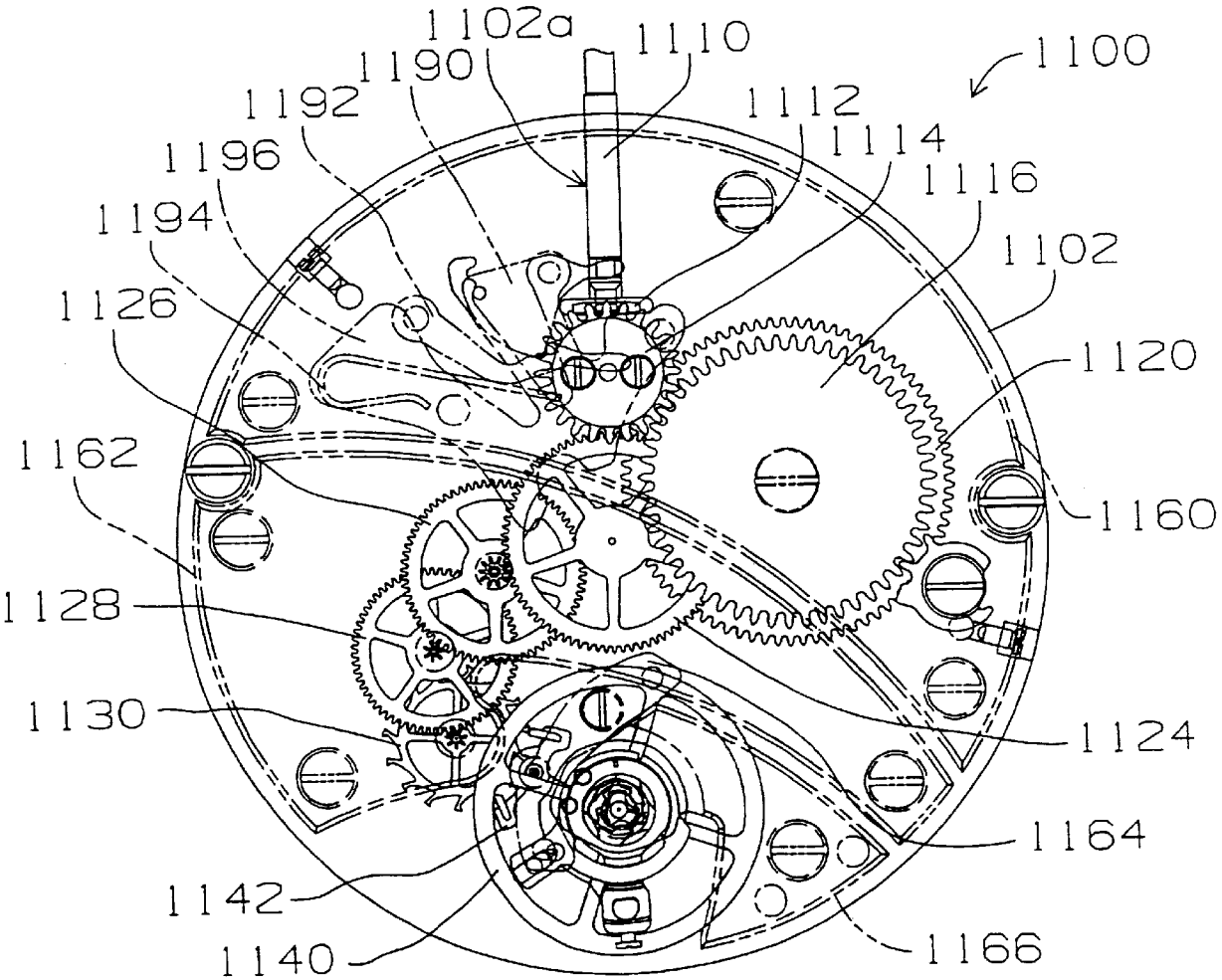
FIG. 13 is a plane view showing an outline shape of a front side of a movement of a conventional mechanical time piece (in FIG. 13, portions of parts are omitted and bridge members are indicated by imaginary lines).
Figure 14:
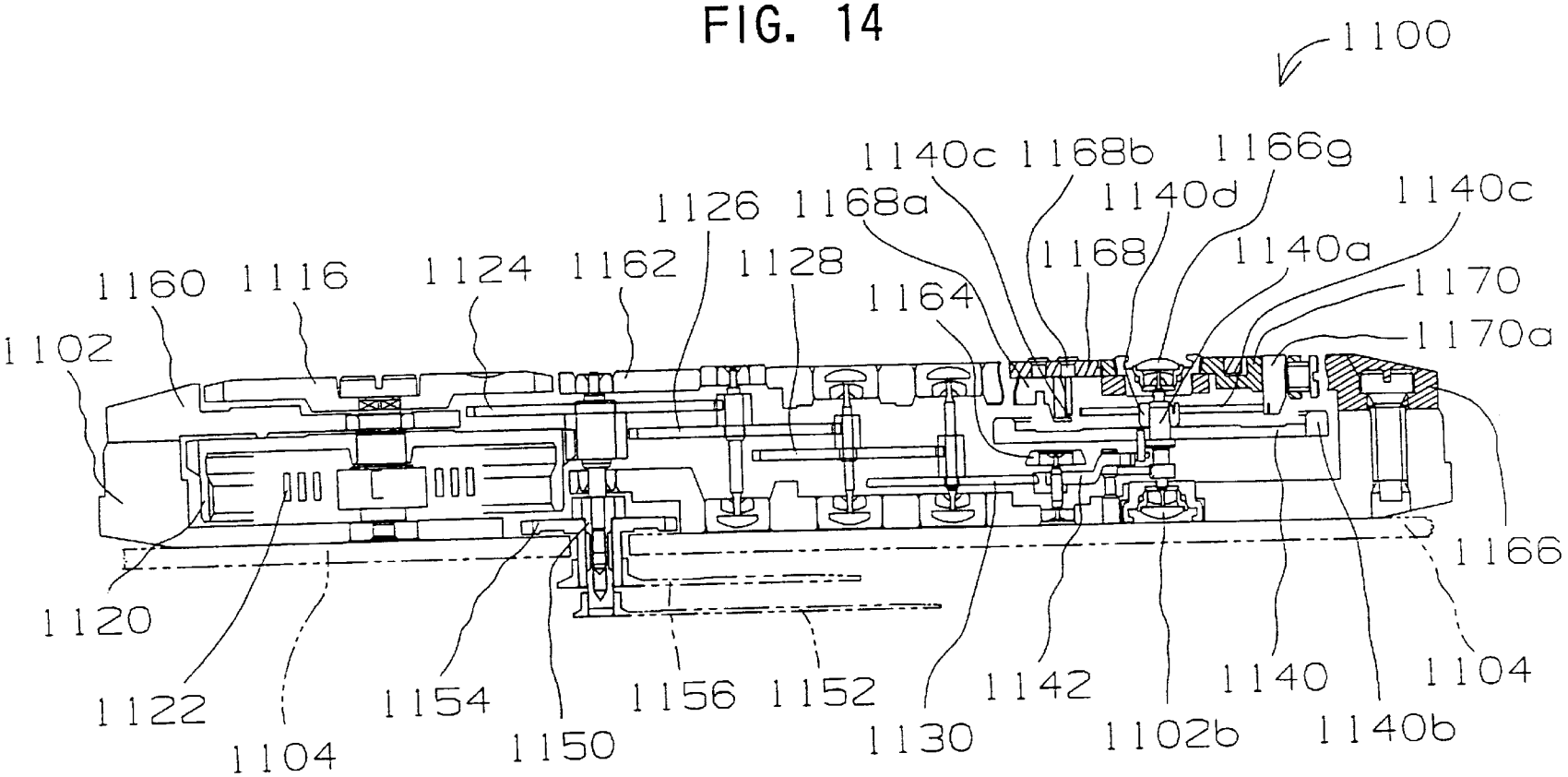
FIG. 14 is an outline partial sectional view of the movement of the mechanical time piece (in FIG. 14, portions of parts are omitted).

In reference to FIG. 12, according to the mechanical time piece of the invention, first, as shown by plots of x marks and a slender line in FIG. 12, the time piece is adjusted in a state in which the instantaneous rate of the time piece is gained. According to the mechanical time piece of the invention, in the case in which the balance with hairspring 140 is rotated by a certain angle or more, when the outer end portion of the hairspring 140*c* is brought into contact with the first terminal member 168*a* or the second terminal member 168*b*, the effective length of the hairspring 140*c* is shortened and accordingly, the instantaneous rate is further gained.

That is, according to the mechanical time piece of the invention, in a state in which the outer end portion of the hairspring 140*c* is not brought into contact with the first terminal member 168*a* and is not brought into contact with the second terminal member 168*b*, as shown by the plots of x marks and the slender line in FIG. 12, in a state in which the main spring is completely wound up, the rate is about 18 seconds/day (gain of about 18 seconds per day), after elapse of 20 hours from the fully wound state, the instantaneous rate becomes about 13 seconds/day (gain of about 13 seconds/day) and after elapse of 30 hours from the fully wound state, the instantaneous rate becomes about −2 seconds/day (loss of 2 seconds per day).

Further, according to the mechanical time piece of the invention, when the balance rotational angle control mechanism is assumed not to operate, as shown by plots of triangle and a bold line in FIG. 12, in a state in which the outer end portion of the hairspring 140*c* is brought into contact with the first terminal member 168*a* or the second terminal member 168*b*, in the state in which the mainspring is completely wound up, the rate is about 25 seconds/day (gain of about 25 seconds per day), after elapse of 20 hours from the fully wound state, the instantaneous rate becomes about 20 seconds/day (gain of about 20 seconds per day) and after elapse of 30 hours from the fully wound state, the instantaneous rate becomes about 5 seconds/day (gain of about 5 seconds per day).

In contrast thereto, according to the mechanical time piece of the invention, when the balance rotational angle control mechanism is operated, as shown by plots of black circle and an extremely bold line in FIG. 12, the instantaneous rate can be maintained at about 5 seconds/day (state of gaining by about 5 seconds per day is maintained) in the state in which the balance rotational angle control mechanism is operated, that is, until elapse of 27 hours from the state in which the mainspring is completely wound up and after elapse of 30 hours from the fully wound state, the instantaneous rate becomes about −2 seconds/day (loss of about 2 seconds per day).

According to the mechanical time piece having the balance rotational angle control mechanism of the invention, by controlling the swing angle of the balance with hairspring, the change in the instantaneous rate of the time piece is restrained and accordingly, in comparison with the conventional mechanical time piece shown by plots of square and an imaginary line in FIG. 12, an elapse time period from the fully wound state in which the instantaneous rate is about 0 through 5 seconds/day can be prolonged.

That is, according to the mechanical time piece of the invention, a duration time period in which the instantaneous rate falls within about plus and minus 5 seconds/day is about 32 hours. A value of the duration time period is a duration time period in which the instantaneous rate in the conventional mechanical time piece falls within about plus and minus 5 seconds/day or about 22 hours multiplied by 1.45.

Therefore, according to the mechanical time piece of the invention, in comparison with the conventional mechanical time piece, there is achieved the result of the simulation in which accuracy is every excellent.

(4) Switch Adjusting Apparatus Used in Mechanical Time Piece of the Invention Next, an explanation will be given of a switch adjusting apparatus used for adjusting positions of the first terminal member and the second terminal member relative to the portion 140 proximate to the outer end portion of the hairspring and an interval between the first terminal member and the second terminal member.

Figure 15:
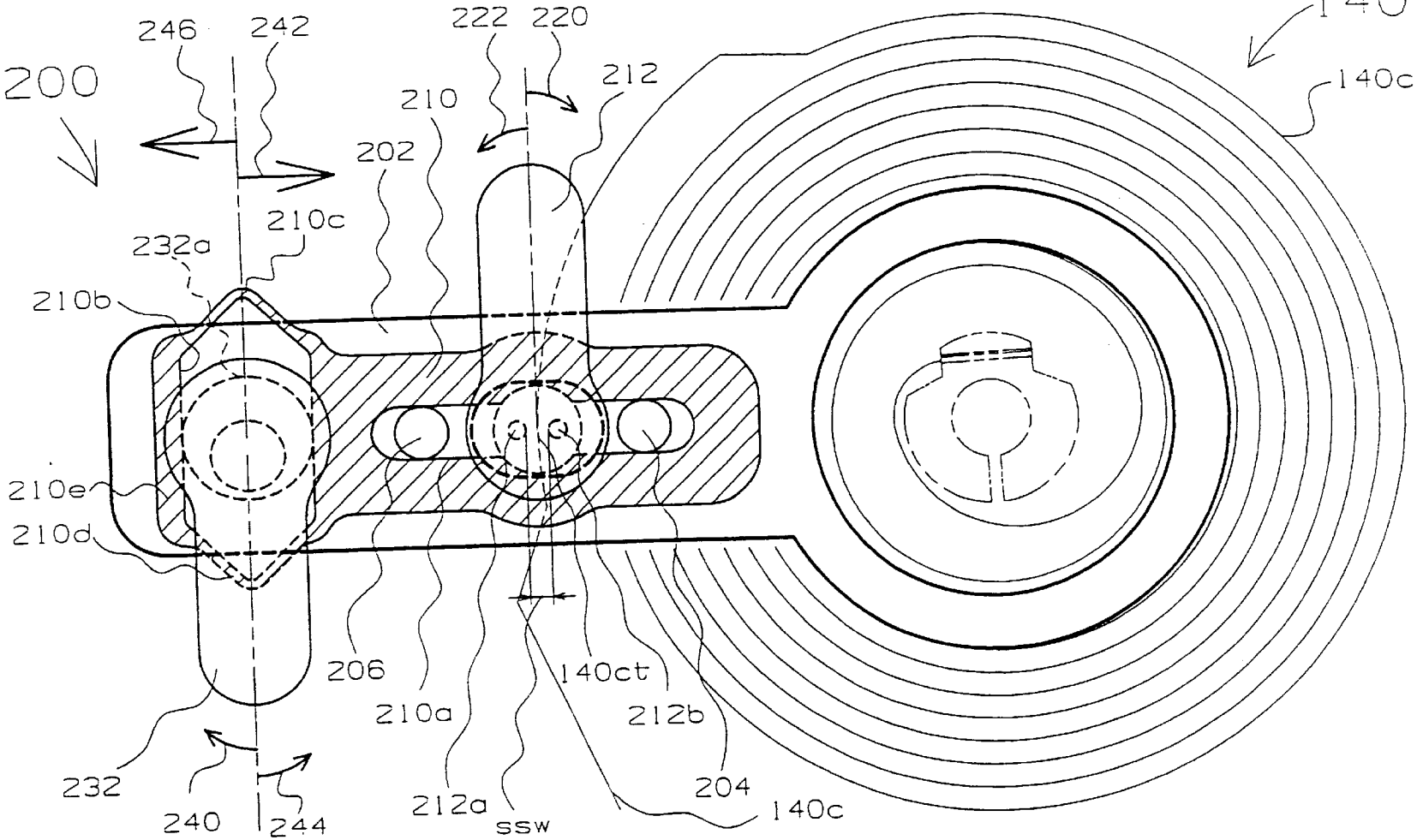
FIG. 15 is a plane view showing a switch adjusting apparatus used in a mechanical time piece according to the invention.
Figure 16:
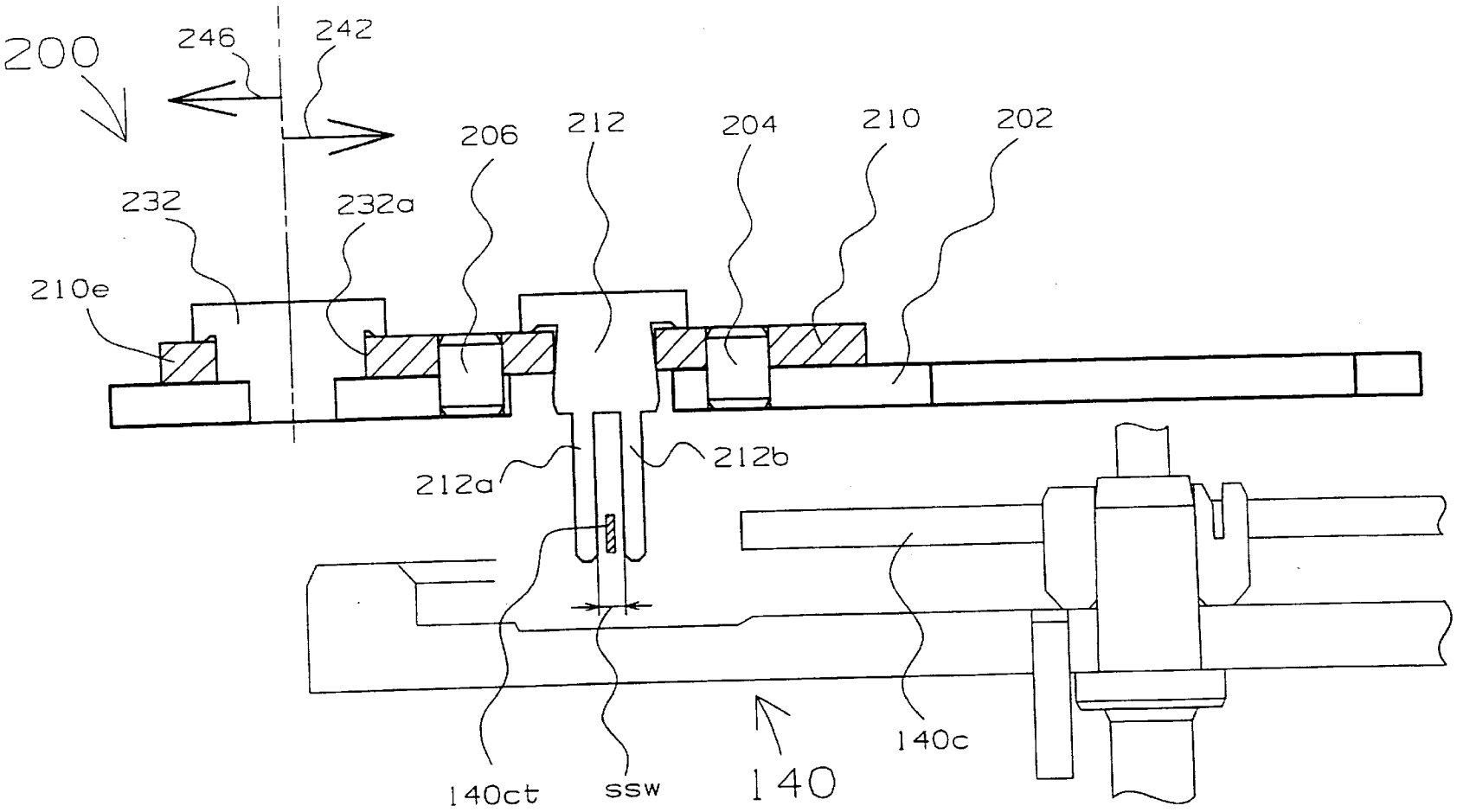
FIG. 16 is a sectional view showing the switch adjusting apparatus used in the mechanical time piece of the invention.

In reference to FIG. 15 and FIG. 16, a switch adjusting apparatus 200 includes a switch member 202, a first guide pin 204 and a second guide pin 206 provided to the switch member 202. The switch member 202 are formed by a metal such as iron or brass or plastic. The first guide pin 204 and the second guide pin 206 are formed by a metal such as iron or brass or plastic. The first guide pin 204 and the second guide pin 206 may be formed as members separate from the switch member 202 and fixed to the switch member 202 or the first guide pin 204 and the second guide pin 206 may be formed integrally with the switch member 202. The switch member 202 is attached to the balance bridge (not illustrated) to be rotatable centering on the rotational center of the balance with hairspring 140.

A switch insulating member 210 is arranged to a side of the switch member 202 opposed to a side thereof opposed to the balance with hairspring 140. The switch insulating member 210 is formed by an insulating material of plastic or the like and is formed by an elastically deformable material. A first long hole 210*a* is provided to the switch insulating member 210, the first guide pin 204 and the second guide pin 206 are fitted into the first long hole 210*a* and the switch insulating member 210 is arranged slidably to the switch member 202. A direction of sliding the switch insulating member 210 coincides with a straight line passing through a center of the first guide pin 204 or the second guide pin 206 and the center of the balance with hairspring 140.

A switch interval adjusting lever 212 is provided to the switch insulating member 210 rotatably by a slip mechanism. An outer peripheral portion of a cylindrical portion of the switch interval adjusting lever 212 is integrated to a circular portion provided at a portion of the first long hole 210*a* of the switch insulating member 210. The circular portion provided at the portion of the first long hole 210*a* of the switch insulating member 210, is constituted to be fitted to the cylindrical portion of the switch interval adjusting lever 212 by way of elastic force and accordingly, rotation of the switch interval adjusting lever 212 can be fixed at an arbitrary position.

A first terminal portion 212*a* and a second terminal portion 212*b* are provided on a side of the switch interval adjusting lever 212 opposed to the balance with hairspring 140. The first terminal portion 212*a* and the second terminal portion 212*b* are provided at positions eccentric to the rotational center of the switch interval adjusting lever 212. The first terminal portion 212*a* and the second terminal portion 212*b* are formed to constitute line symmetry relative to a straight line including the rotational center of the switch interval adjusting lever 212.

The portion 140*ct* proximate to the outer end portion of the hairspring 140*c* is disposed in a clearance SSW between the first terminal portion 212*a* and the second terminal portion 212*b*. For example, the clearance SSW is about 0.06 millimeter.

The first terminal portion 212*a* and the second terminal portion 212*b* can be rotated by rotating the switch interval adjusting lever 212 in a direction of a narrow mark 220 (clockwise direction in FIG. 15) or a direction of an arrow mark 222 (counterclockwise direction in FIG. 15). Thereby, the distance SSW between the first terminal portion 212*a* and the second terminal portion 212*b* in the direction of the straight line passing through the center of the balance with hairspring 140 can be changed.

Further, a switch position adjusting lever 232 is provided to the switch member 202 rotatably by a slip mechanism and can be fixed at an arbitrary position. An eccentric portion 232*a* of the switch position adjusting lever 232 is fitted to a second long hole 210*b* of the switch insulating member 210. A direction of a central axis line in the longitudinal direction of the second long hole 210*b* is orthogonal to the direction of the straight line passing through the center of the first guide pin 204 or the second guide pin 206 and the center of the balance with hairspring 140. That is, the direction of the central axis line in the longitudinal direction of the second long hole 210*b* is orthogonal to the direction of the central axis line in the longitudinal direction of the first long hole 210*a*. Elastic deformable portions 210*c* and 210*d* of the switch insulating member 210 the widths of which are formed to be elastically deformable, are provided at both end portions in the longitudinal direction of the second long hole 210*b*. A rigid portion 210*e* of the switch insulating member 210, the width of which is formed not to be elastically deformable, is provided on an outer side (side remote from the outer end portion of the mainspring 140*c*) of the second long hole 210*b*. Therefore, the width of the rigid portion 210*e* is formed to be larger than the widths of the elastically deformable portions 210*c* and 210*d*. The inner side of the rigid portion 210*e* is arranged to be brought into contact with the eccentric portion 232*a* of the switch position adjusting lever 232.

By rotating the switch position adjusting lever 232 in a direction of an arrow mark 240 (clockwise direction in FIG. 15), the eccentric portion 232*a* can be rotated. Thereby, the switch insulating member 210 can be moved in a direction toward the center of the balance with hairspring 140 (direction of arrow mark 242 in FIG. 15 and FIG. 16) in the direction of the straight line passing through the center of the balance with hairspring 140. As a result, the first terminal portion 212*a* is moved to be proximate to the portion 140*ct* proximate to the outer end portion of the hairspring 140*c* and the second terminal portion 212*b* is moved to be remote from the portion 140*ct* proximate to the outer end portion of the hairspring 140*c*.

By rotating the switch position adjusting lever 232 in a direction of an arrow mark 244 (counterclockwise direction in FIG. 15), the eccentric portion 232*a* can be rotated. Thereby, the switch insulating member 210 can be moved in a direction remote from the center of the balance with hairspring 140 (direction of arrow mark 246 in FIG. 15 and FIG. 16). As a result, the first terminal portion 212*a* is moved to be remote from the portion 140*ct* proximate to the outer end portion of the hairspring 140*c* and the second terminal portion 212*b* is moved to be proximate to the portion 140*ct* proximate to the outer end portion of the hairspring 140*c*.

Figure 17:
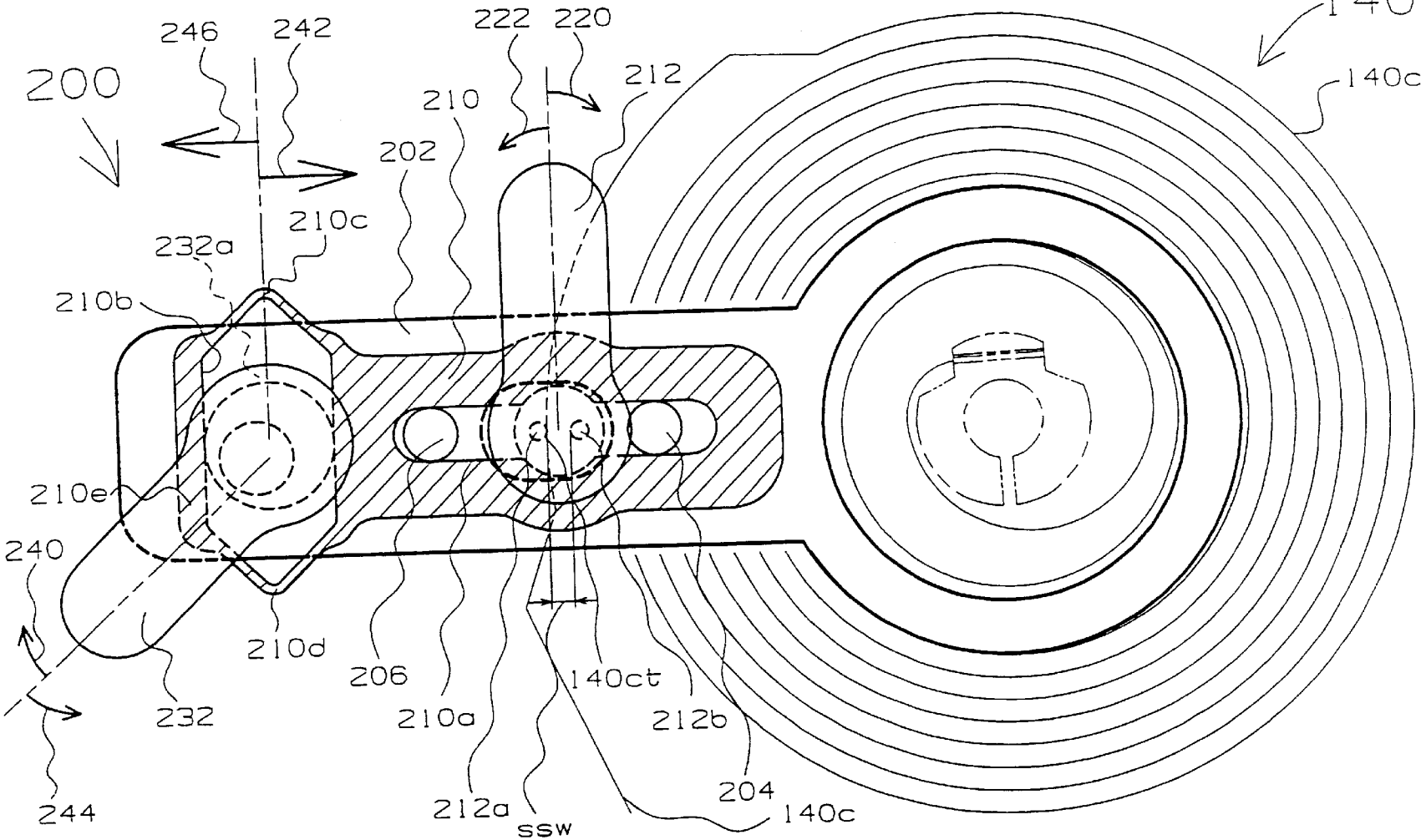
FIG. 17 is a plane view showing a state of rotating a switch position adjusting lever in the switch adjusting apparatus used in the mechanical time piece of the invention.
Figure 18:
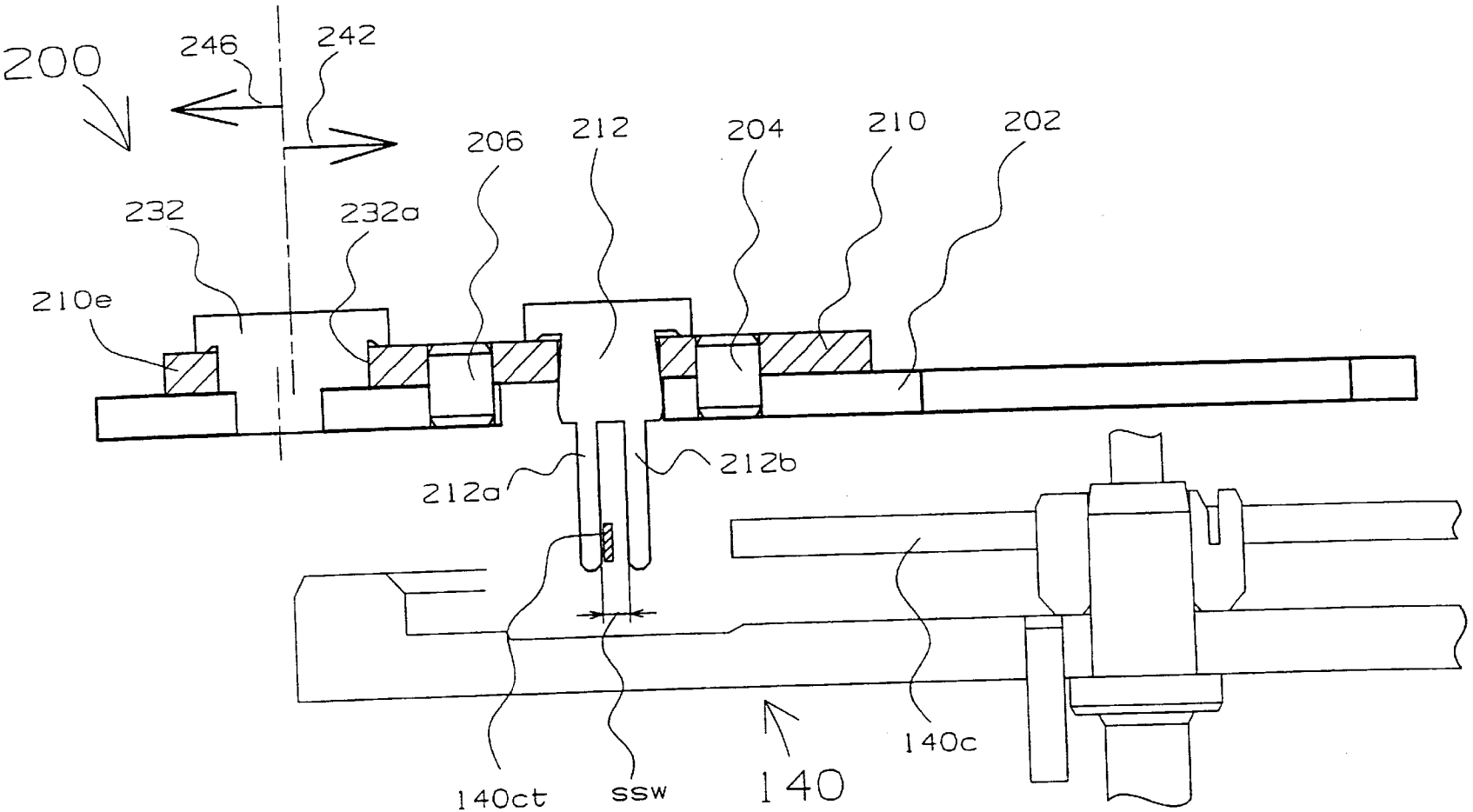
FIG. 18 is a sectional view showing a state of rotating the switch position adjusting lever in the switch adjusting apparatus used in the mechanical time piece of the invention.

FIG. 17 and FIG. 18 illustrate a state in which the switch position adjusting lever 232 is rotated in the direction of the arrow mark 240 (clockwise direction in FIG. 15) in FIG. 15 and FIG. 16. By rotating the switch position adjusting lever 232, the eccentric portion 232*a* is rotated, the switch insulating member 210 is moved in the direction toward the center of the balance with hairspring 140, the first terminal portion 212*a* becomes proximate to the portion 140*ct* proximate to the outer end portion of the hairspring 140*c* and the second terminal portion 212*b* becomes remote from the portion 140*ct* proximate to the outer end portion of the hairspring 140*c*. In such operation of rotating the switch position adjusting lever 232, the clearance SSW between the first terminal portion 212*a* and the second terminal portion 212*b* remains unchanged.

Figure 19:
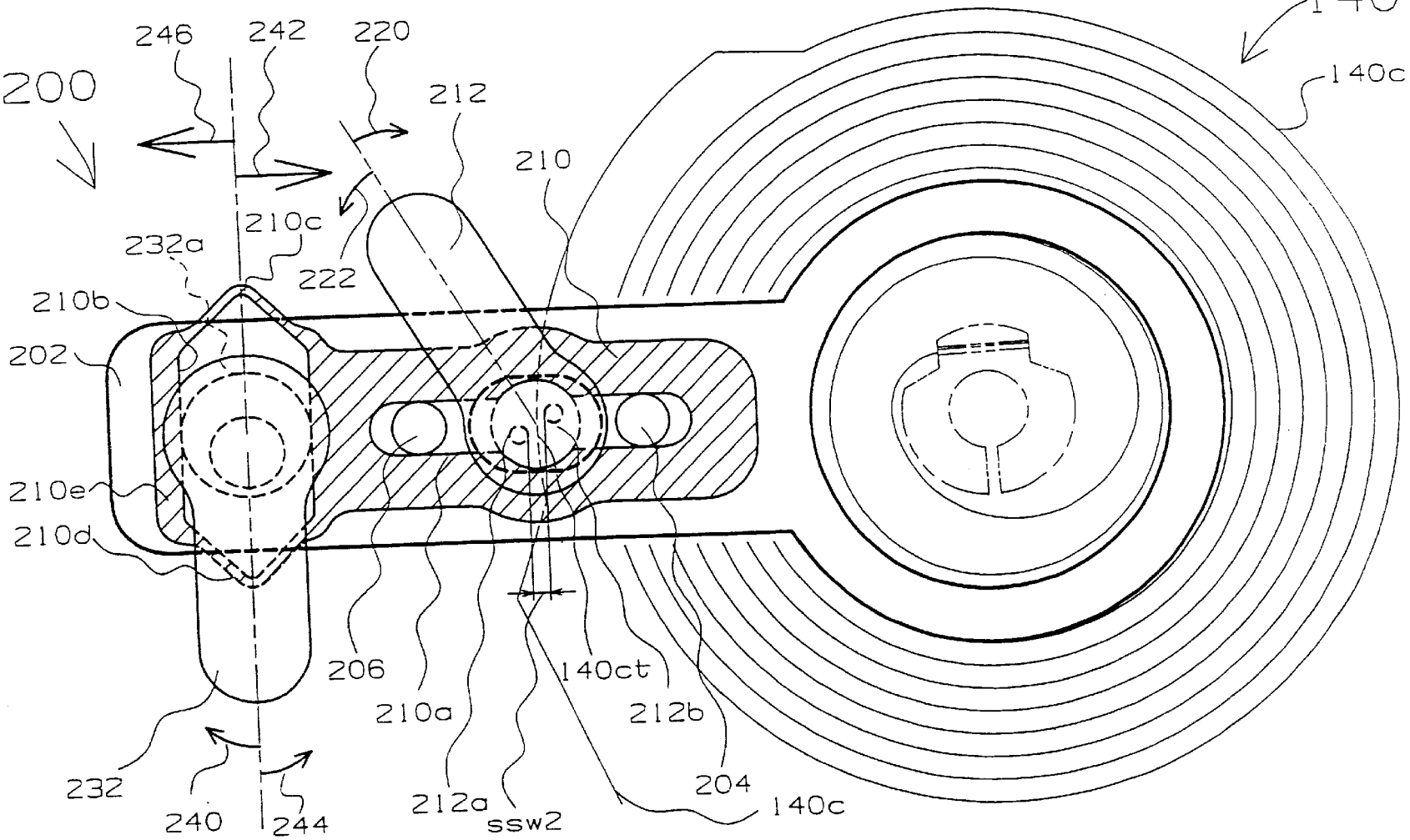
FIG. 19 is a plane view showing a state of rotating a switch interval adjusting lever in the switch adjusting apparatus used in the mechanical time piece of the invention.
Figure 20:
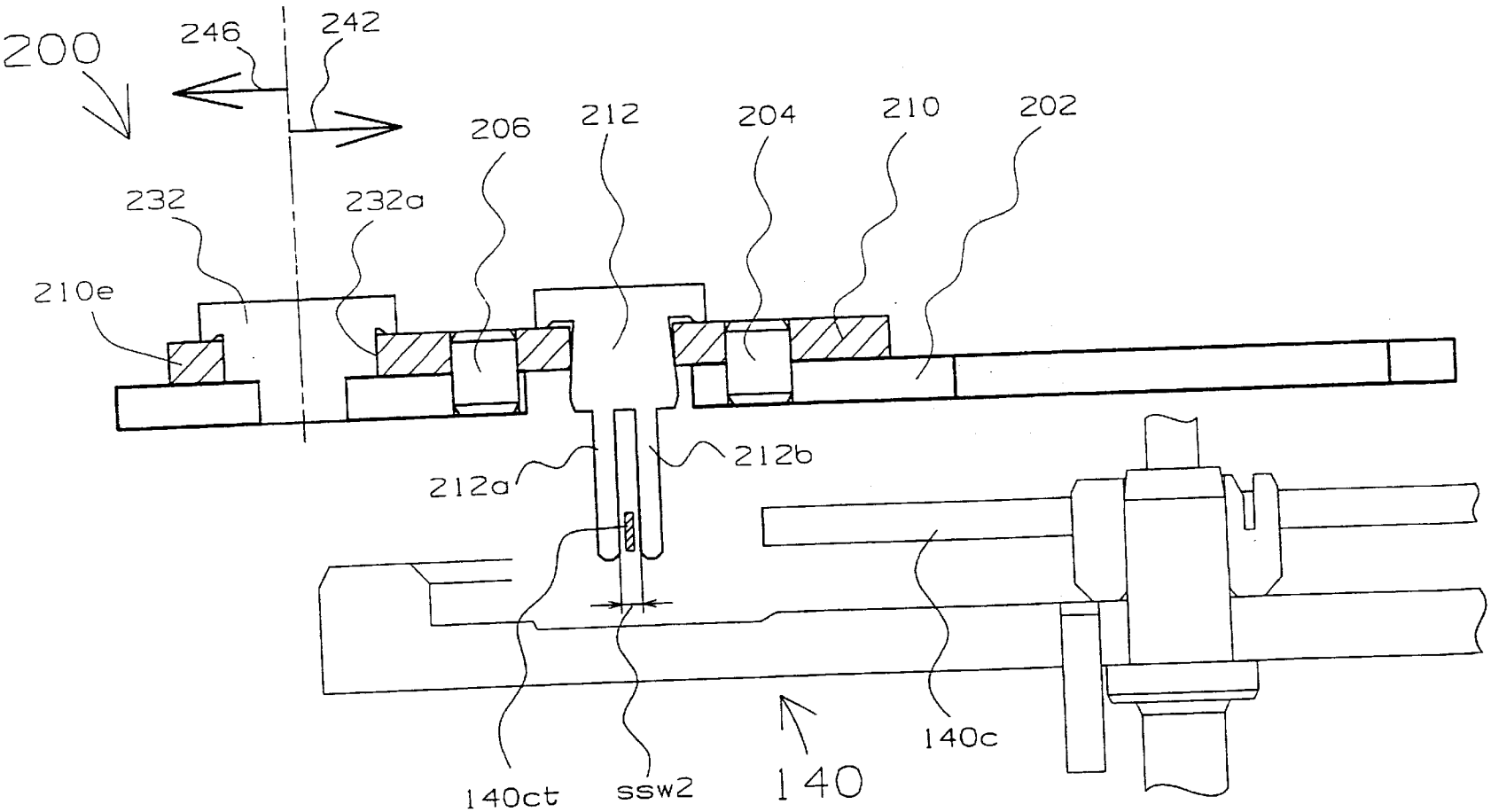
FIG. 20 is a sectional view showing the state of rotating the switch interval adjusting lever in the switch adjusting apparatus used in the mechanical time piece of the invention.

FIG. 19 and FIG. 20 illustrate a state in which the switch interval adjusting lever 212 is rotated in the direction of the arrow mark 222 (counterclockwise direction in FIG. 15) in FIG. 15 and FIG. 16. By rotating the switch interval adjusting lever 212, the first terminal portion 212*a* and the second terminal portion 212*b* are rotated, the distance between the first terminal portion 212*a* and the second terminal portion 212*b* in the direction of the straight line passing through the center of the balance with hairspring 140, is reduced. Therefore, the distance between the first terminal portion 212*a* and the second terminal portion 212*b* in the direction of the straight line passing through the center of the balance with hairspring 140 is changed to SSW2 smaller than SSW.

As has been explained, according to the mechanical time piece of the invention, by using the switch adjusting apparatus 200, the positions of the first terminal portion 212*a* and the second terminal portion 212*b* relative to the portion 140*ct* proximate to the outer end portion of the hairspring can be adjusted and by adjusting the interval between the first terminal portion 212*a* and the second terminal portion 212*b*, the distance between the portion 140*ct* proximate to the outer end portion of the hairspring and the first terminal portion 212*a* and the distance between the portion 140*ct* proximate to the outer end portion of the hairspring and the second terminal portion 212*b* can be adjusted.

By applying the above-described two adjusting mechanisms to the switch adjusting apparatus, swing angles for making the switch ON/OFF can easily be adjusted.

Therefore, when the switch adjusting apparatus 200 is used in the mechanical time piece of the invention shown in FIG. 1 and FIG. 2, the first terminal portion 212*a* may be arranged in place of the first terminal member 168*a* and the second terminal portion 212*b* may be arranged in place of the second terminal member 168*b*.

The switch adjusting apparatus for the mechanical time piece according to the invention is applicable to a regulating apparatus for an existing mechanical time piece. In such a case, the first terminal portion 212*a* corresponds to a regulator and the second terminal portion 212*b* corresponds to a hairspring rod.

By such a constitution, the regulator and the hairspring rod of the mechanical time piece can be adjusted accurately and efficiently.

INDUSTRIAL APPLICABILITY

The mechanical time piece of the invention is provided with the simple structure and is suitable for realizing a mechanical time piece having very excellent accuracy.

Further, the mechanical time piece of the invention is provided with the new balance rotational angle control mechanism and accordingly, a mechanical time piece having high accuracy can be fabricated further efficiently than a conventional time piece.

What is claimed is:

1. A mechanical time piece comprising: a mainspring for generating a rotational force; a front train wheel for undergoing rotation in accordance with the rotational force generated by the mainspring; an escapement and speed control apparatus for controlling rotation of the front train wheel and having a timed annular balance for undergoing reciprocal rotational movement, an escape wheel and pinion for undergoing rotation in accordance with rotation of the front train wheel, and a pallet fork for controlling rotation of the escape wheel and pinion in accordance with rotational movement of the timed annular balance; a switch mechanism for outputting an ON signal when a rotational angle of the timed annular balance becomes equal to or larger than a predetermined threshold angle and for outputting an OFF signal when the rotational angle of the timed annular balance does not exceed the threshold angle; and a balance rotational angle control mechanism for applying a force to the timed annular balance to restrain rotation of the timed annular balance when the switch mechanism outputs the ON signal, the balance rotational angle control mechanism having a balance magnet disposed on the timed annular balance and a plurality of coils for exerting a magnetic force to the balance magnet to thereby restrain rotation of the timed annular balance when the switch mechanism outputs the ON signal and for not exerting a magnetic force to the balance magnet when the switch mechanism outputs the OFF signal.

2. A mechanical timepiece according to claim 1; further comprising a main plate and a balance bridge rotatably supporting the timed annular balance, a switch lever rotatably mounted on the balance with bridge and having a plurality of terminal members; and wherein the timed annular balance has a hairspring for contacting the terminal members when the switch mechanism outputs the ON signal.

3. A mechanical time piece according to claim 1; further comprising a main plate, a bearing member disposed on the main plate, and a coil bridge guided by the bearing member and connected to the coils.

4. A mechanical time piece according to claim 1; further comprising a circuit board having a plurality of electrical patterns for conducting electricity to the coils, a main plate having a plurality of guide holes, and a plurality of coil bridges connected to the coils and the circuit board and guided by the guide holes of the main plate.

5. A mechanical time piece according to claim 1; wherein the switch mechanism has a first terminal member, a second terminal member, and an adjusting apparatus for changing an interval between the first terminal member and the second terminal member.

6. A mechanical time piece according to claim 1; wherein the switch mechanism has a first terminal member, a second terminal member, and an adjusting apparatus for simultaneously moving the first terminal member and the second terminal member relative to a rotational center of the timed annular balance.

7. A mechanical timepiece according to claim 1; further comprising a circuit board having a plurality of electrical patterns for conducting electricity to the coils.

8. A mechanical time piece according to claim 7; wherein the coils have a plurality of wiring portions disposed on a side of a main plate of the circuit board.

9. A mechanical time piece according to claim 8; wherein the switch mechanism has a first terminal member, a second terminal member, and an adjusting apparatus for changing an interval between the first terminal member and the second terminal member.

10. A mechanical time piece according to claim 8; wherein the switch mechanism has a first terminal member, a second terminal member, and an adjusting apparatus for simultaneously moving the first terminal member and the second terminal member relative to a rotational center of the timed annular balance.

11. A mechanical time piece according to claim 8; further comprising a main plate, a bearing member disposed on the main plate, and a coil bridge guided by the bearing member and connected to the coils.

12. A mechanical timepiece according to claim 11; further comprising a circuit board connected to the coil bridge and having a plurality of electrical patterns for conducting electricity to the coils.

13. A mechanical time piece according to claim 11; wherein the switch mechanism has a first terminal member, a second terminal member, and an adjusting apparatus for changing an interval between the first terminal member and the second terminal member.

14. A mechanical time piece according to claim 11; wherein the switch mechanism has a first terminal member, a second terminal member, and an adjusting apparatus for simultaneously moving the first terminal member and the second terminal member relative to a rotational center of the timed annular balance.

15. A mechanical time piece according to claim 8; further comprising a circuit board having a plurality of electrical patterns for conducting electricity to the coils, a main plate having a plurality of guide holes, and a plurality of coil bridges connected to the coils and the circuit board and guided by the guide holes of the main plate.

16. A mechanical time piece according to claim 15; wherein the circuit board has a plurality of patterns for electrically connecting lead wires to the switch mechanism.

17. A mechanical time piece according to claim 16; wherein the switch mechanism has a first terminal member, a second terminal member, and an adjusting apparatus for changing an interval between the first terminal member and the second terminal member.

18. A mechanical time piece according to claim 16; wherein the switch mechanism has a first terminal member, a second terminal member, and an adjusting apparatus for simultaneously moving the first terminal member and the second terminal member relative to a rotational center of the timed annular balance.

19. A mechanical time piece according to claim 15; wherein the coils are connected in series by the electrical patterns of the circuit board.

20. A mechanical time piece according to claim 19; wherein the switch mechanism has a first terminal member, a second terminal member, and an adjusting apparatus for changing an interval between the first terminal member and the second terminal member.

21. A mechanical time piece according to claim 19; wherein the switch mechanism has a first terminal member, a second terminal member, and an adjusting apparatus for simultaneously moving the first terminal member and the second terminal member relative to a rotational center of the timed annular balance.

22. A mechanical time piece according to claim 15; wherein the switch mechanism has a first terminal member, a second terminal member, and an adjusting apparatus for changing an interval between the first terminal member and the second terminal member.

23. A mechanical time piece according to claim 15; wherein the switch mechanism has a first terminal member, a second terminal member, and an adjusting apparatus for simultaneously moving the first terminal member and the second terminal member relative to a rotational center of the timed annular balance.

24. A mechanical timepiece comprising: a front train wheel mounted to undergo rotation; a control mechanism for controlling rotation of the front train wheel and having a timed annular balance for undergoing reciprocal rotational movement; a switch mechanism for outputting an ON signal when a rotational angle of the timed annular balance becomes equal to or larger than a predetermined threshold angle and for outputting an OFF signal when the rotational angle of the timed annular balance does not exceed the threshold angle; and a balance rotational angle control mechanism having a balance magnet disposed on the timed annular balance and a plurality of coils for applying a magnetic force to the balance magnet to suppress rotation of the timed annular balance when the switch mechanism outputs an ON signal but not when the switch mechanism outputs an OFF signal.

* * * * *